US011912955B1

(12) United States Patent
Field et al.

(10) Patent No.: US 11,912,955 B1
(45) Date of Patent: Feb. 27, 2024

(54) LUBRICATING COMPOSITIONS FOR REDUCED LOW TEMPERATURE VALVE TRAIN WEAR

(71) Applicant: Afton Chemical Corporation, Richmond, VA (US)

(72) Inventors: Samuel Bruce Field, Windsor (GB); Kenneth Garelick, Mechanicsville, VA (US); Hidetaka Hoshino, Yokohama (JP); Guillaume Carpentier, Bracknell (GB)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 18/050,843

(22) Filed: Oct. 28, 2022

(51) Int. Cl.

| | |
|---|---|
| ***C10M 135/18*** | (2006.01) |
| ***C10M 135/10*** | (2006.01) |
| ***C10M 145/14*** | (2006.01) |
| ***C10M 149/10*** | (2006.01) |
| ***C10M 169/04*** | (2006.01) |
| *C10N 10/04* | (2006.01) |
| *C10N 10/12* | (2006.01) |
| *C10N 20/02* | (2006.01) |
| *C10N 30/00* | (2006.01) |
| *C10N 30/02* | (2006.01) |
| *C10N 30/04* | (2006.01) |
| *C10N 40/25* | (2006.01) |

(52) U.S. Cl.
CPC ..... *C10M 135/18* (2013.01); *C10M 135/10* (2013.01); *C10M 145/14* (2013.01); *C10M 149/10* (2013.01); *C10M 169/04* (2013.01); *C10M 2209/08* (2013.01); *C10M 2217/028* (2013.01); *C10M 2219/046* (2013.01); *C10M 2219/068* (2013.01); *C10N 2010/04* (2013.01); *C10N 2010/12* (2013.01); *C10N 2020/02* (2013.01); *C10N 2030/02* (2013.01); *C10N 2030/04* (2013.01); *C10N 2030/52* (2020.05); *C10N 2030/54* (2020.05); *C10N 2040/25* (2013.01)

(58) Field of Classification Search
CPC ..... C10M 135/18; C10M 135/10; C10M 145/14; C10M 149/10; C10M 169/04; C10M 2209/08; C10M 2217/028; C10M 2219/046; C10M 2219/068; C10N 2010/04; C10N 2010/12; C10N 2020/02; C10N 2030/02; C10N 2030/04; C10N 2030/52; C10N 2030/54; C10N 2040/25
See application file for complete search history.

(56) References Cited

U.S. PATENT DOCUMENTS

| | | | |
|---|---|---|---|
| 1,857,214 | A | 5/1932 | Rowe |
| 2,995,569 | A | 8/1961 | Hamilton et al. |
| 3,178,663 | A | 4/1965 | Kahn |
| 3,185,647 | A | 5/1965 | Anderson et al. |
| 3,189,544 | A | 6/1965 | Ratner et al. |
| 3,256,185 | A | 6/1966 | Le Suer |
| 3,278,550 | A | 10/1966 | Norman et al. |
| 3,312,619 | A | 4/1967 | Vineyard |
| 3,366,569 | A | 1/1968 | Norman et al. |
| 3,390,086 | A | 6/1968 | O'Halloran |
| 3,403,102 | A | 9/1968 | Le Suer |
| 3,458,530 | A | 7/1969 | Siegel et al. |
| 3,470,098 | A | 9/1969 | O'Halloran |
| 3,471,404 | A | 10/1969 | Myers |
| 3,502,677 | A | 3/1970 | Le Suer |
| 3,519,564 | A | 7/1970 | Vogel |
| 3,546,243 | A | 12/1970 | Coupland |
| 3,573,205 | A | 3/1971 | Lowe et al. |
| 3,634,515 | A | 1/1972 | Piasek et al. |
| 3,649,229 | A | 3/1972 | Otto |
| 3,673,090 | A | 6/1972 | Waldbillig et al. |
| 3,703,504 | A | 11/1972 | Horodysky |
| 3,703,505 | A | 11/1972 | Horodysky et al. |
| 3,708,522 | A | 1/1973 | Le Suer |
| 3,749,695 | A | 7/1973 | de Vries |
| 3,796,661 | A | 3/1974 | Suratwala |
| 3,859,318 | A | 1/1975 | Lesuer |
| 3,865,740 | A | 2/1975 | Goldschmidt |
| 3,865,813 | A | 2/1975 | Gergel |
| 3,873,454 | A | 3/1975 | Horodysky et al. |
| 3,954,639 | A | 5/1976 | Liston |
| 4,119,549 | A | 10/1978 | Davis |
| 4,119,550 | A | 10/1978 | Davis et al. |
| 4,147,640 | A | 4/1979 | Jayne et al. |
| 4,152,499 | A | 5/1979 | Boerzel et al. |
| 4,191,659 | A | 3/1980 | Davis |
| 4,204,969 | A | 5/1980 | Papay et al. |
| 4,234,435 | A | 11/1980 | Meinhardt et al. |

(Continued)

FOREIGN PATENT DOCUMENTS

| | | | |
|---|---|---|---|
| CN | 102575186 | A | 7/2012 |
| EP | 612839 | A1 | 8/1994 |

(Continued)

OTHER PUBLICATIONS

Huanmou et al., "Lubricity of Carboxyl Acid Derivatives of O,O-dialkyl-phosphorodithioate," Journal of Hunan University, vol. 23, No. 3, (1996), pp. 65-70.

*Primary Examiner* — Ellen M McAvoy
*Assistant Examiner* — Chantel Graham
(74) *Attorney, Agent, or Firm* — Honigman LLP

(57) ABSTRACT

The present disclosure relates to lubricating compositions including effective amounts of molybdenum from an oil-soluble molybdenum compound and a magnesium boost in the detergent system to achieve passing motor friction and valve train wear performance.

20 Claims, No Drawings

(56) References Cited

U.S. PATENT DOCUMENTS 4,240,958 A 12/1980 Braid
4,259,194 A 3/1981 DeVries et al.
4,259,195 A 3/1981 King et al.
4,261,843 A 4/1981 King et al.
4,263,152 A 4/1981 King et al.
4,265,773 A 5/1981 DeVries et al.
4,272,387 A 6/1981 King et al.
4,283,295 A 8/1981 DeVries et al.
4,285,822 A 8/1981 deVries et al.
4,344,854 A 8/1982 Davis et al.
4,379,064 A 4/1983 Cengel et al.
4,472,306 A 9/1984 Powers et al.
4,482,464 A 11/1984 Karol et al.
4,521,318 A 6/1985 Karol
4,554,086 A 11/1985 Karol et al.
4,579,675 A 4/1986 Sawicki et al.
4,612,132 A 9/1986 Wollenberg et al.
4,614,522 A 9/1986 Buckley
4,614,603 A 9/1986 Wollenberg
4,617,137 A 10/1986 Plavac
4,617,138 A 10/1986 Wollenberg
4,636,322 A 1/1987 Nalesnik
4,645,515 A 2/1987 Wollenberg
4,646,860 A 3/1987 Owens et al.
4,647,390 A 3/1987 Buckley, III et al.
4,648,886 A 3/1987 Buckley, III et al.
4,648,980 A 3/1987 Erdman
4,652,387 A 3/1987 Andress, Jr. et al.
4,663,062 A 5/1987 Wollenberg
4,663,064 A 5/1987 Nalesnik et al.
4,666,459 A 5/1987 Wollenberg
4,666,460 A 5/1987 Wollenberg
4,668,246 A 5/1987 Wollenberg
4,670,170 A 6/1987 Wollenberg
4,699,724 A 10/1987 Nalesnik et al.
4,711,736 A 12/1987 Horodysky et al.
4,713,189 A 12/1987 Nalesnik et al.
4,713,191 A 12/1987 Nalesnik
4,859,352 A 8/1989 Waynick
4,948,386 A 8/1990 Sung et al.
4,954,274 A 9/1990 Zaweski et al.
4,963,275 A 10/1990 Gutierrez et al.
4,963,278 A 10/1990 Blain et al.
4,966,720 A 10/1990 DeGonia et al.
4,971,598 A 11/1990 Andress et al.
4,971,711 A 11/1990 Lundberg et al.
4,973,412 A 11/1990 Migdal et al.
4,981,492 A 1/1991 Blain et al.
5,026,495 A 6/1991 Emert et al.
5,030,249 A 7/1991 Herbstman et al.
5,039,307 A 8/1991 Herbstman et al.
5,075,383 A 12/1991 Migdal et al.
5,241,003 A 8/1993 DeGonia et al.
5,334,321 A 8/1994 Harrison et al.
5,362,419 A 11/1994 Zinke et al.
5,578,236 A 11/1996 Srinivasan et al.
5,650,381 A 7/1997 Gatto et al.
5,739,355 A 4/1998 Gateau et al.
5,883,057 A 3/1999 Roell et al.
5,922,657 A 7/1999 Camenzind et al.
6,107,257 A 8/2000 Valcho et al.
6,451,745 B1 9/2002 Ward
6,586,374 B1 7/2003 Paul
6,667,281 B2 12/2003 Ikejima et al.
6,723,685 B2 4/2004 Hartley et al.
6,903,056 B2 6/2005 Nagano et al.
7,214,649 B2 5/2007 Loper et al.
7,253,231 B2 8/2007 Devlin et al.
7,485,603 B2 2/2009 Bera et al.
7,645,726 B2 1/2010 Loper
7,732,390 B2 6/2010 Kadkhodayan et al.
7,786,057 B2 8/2010 Bera et al.
7,897,696 B2 3/2011 Huang et al.
8,048,831 B2 11/2011 Loper
8,143,202 B2 3/2012 Peer et al.
8,400,030 B1 3/2013 Tang et al.
8,563,486 B2 10/2013 Tsujimoto et al.
8,664,169 B2 3/2014 Bouffet
8,901,052 B2 12/2014 Sagawa et al.
8,999,904 B2 4/2015 Matsui et al.
9,522,972 B2 12/2016 Visger et al.
9,598,658 B2 3/2017 Scanlon et al.
9,896,634 B2 2/2018 Gao et al.
9,944,877 B2 4/2018 Gao et al.
11,111,454 B2 9/2021 Gillespie et al.
11,130,927 B2 9/2021 Horita et al.
2006/0063685 A1 3/2006 Purmer et al.
2006/0264340 A1 11/2006 Iyer et al.
2007/0037715 A1 2/2007 Okada
2008/0194442 A1 8/2008 Watts et al.
2008/0302422 A1 12/2008 Neveu et al.
2009/0233822 A1 9/2009 Iyer
2009/0233823 A1 9/2009 Fahl et al.
2009/0298729 A1 12/2009 Schober et al.
2009/0318316 A1 12/2009 Morishima
2012/0101017 A1 4/2012 Duggal
2012/0208731 A1 8/2012 Lann et al.
2012/0283159 A1 11/2012 Matsui et al.
2013/0008756 A1 1/2013 Noles, Jr. et al.
2013/0196888 A1 8/2013 Truong-Dinh
2013/0244917 A1 9/2013 Obrecht et al.
2014/0038866 A1 2/2014 Barton
2014/0097059 A1 4/2014 Tang et al.
2014/0107000 A1 4/2014 Ivancic et al.
2014/0249061 A1* 9/2014 Youn ..... C10M 169/04 508/459
2014/0296118 A1 10/2014 Costello et al.
2014/0342960 A1 11/2014 Miller et al.
2015/0210953 A1 7/2015 Davies
2015/0247104 A1 9/2015 Brekan et al.
2015/0291906 A1* 10/2015 DeSantis ..... C10M 133/06 508/304
2015/0322322 A1 11/2015 Sondjaja, et al.
2016/0108337 A1 4/2016 Abraham et al.
2017/0088789 A1 3/2017 Grisso et al.
2017/0130161 A1 5/2017 Vettel et al.
2017/0137739 A1 5/2017 Narine et al.
2017/0306259 A1 10/2017 Ding et al.
2018/0072962 A1 3/2018 Wada et al.
2018/0079990 A1 3/2018 Aoyama
2018/0100114 A1 4/2018 Gao et al.
2018/0100115 A1 4/2018 Gao et al.
2018/0100117 A1 4/2018 Flores-Torres et al.
2018/0100118 A1 4/2018 Flores-Torres et al.
2018/0100119 A1 4/2018 Aoyama
2018/0134983 A1 5/2018 Broutin et al.
2018/0148663 A1 5/2018 Andoh
2018/0245015 A1* 8/2018 Moniz ..... C10M 163/00
2018/0327687 A1 11/2018 Kwak
2018/0346839 A1 12/2018 Fletcher
2019/0002785 A1 1/2019 Sanson et al.
2019/0002790 A1 1/2019 Sanson et al.
2019/0024007 A1 1/2019 Lim et al.
2019/0112541 A1 4/2019 Hamachi
2019/0367830 A1 12/2019 Iwai
2020/0033218 A1 1/2020 Sato et al.
2020/0248095 A1 8/2020 Guerin
2020/0277541 A1 9/2020 Meyke et al.
2020/0277542 A1 9/2020 Salvi et al.
2021/0139805 A1 5/2021 Champagne
2021/0179961 A1 6/2021 Nga et al.
2021/0253928 A1 8/2021 Lacroix et al.
2021/0253971 A1 8/2021 Lacroix et al.
2021/0277322 A1 9/2021 Lacroix

FOREIGN PATENT DOCUMENTS

EP 0894845 A1 2/1999
EP 1233054 A2 8/2002
EP 1262538 A2 12/2002
EP 0856042 B1 1/2003
EP 1529831 A2 5/2005
EP 2446004 A1 5/2012
EP 2245124 B1 5/2016

(56) References Cited

FOREIGN PATENT DOCUMENTS

| | | | |
|---|---|---|---|
| GB | 1065595 | A | 4/1967 |
| GB | 2140811 | A | 12/1984 |
| JP | 2003027077 | A | 7/2001 |
| JP | 2009242547 | A | 10/2009 |
| JP | 2012031359 | A | 2/2012 |
| JP | 2014025081 | A | 2/2014 |
| JP | 2015098592 | A | 5/2015 |
| JP | 2019533736 | A | 11/2019 |
| WO | 2014186318 | A1 | 11/2014 |
| WO | 2017189277 | A1 | 11/2017 |
| WO | 2017210388 | A1 | 12/2017 |
| WO | 2018139130 | A1 | 8/2018 |

* cited by examiner

LUBRICATING COMPOSITIONS FOR REDUCED LOW TEMPERATURE VALVE TRAIN WEAR

TECHNICAL FIELD

The present disclosure relates to lubricating compositions and, in particular, lubricating compositions providing improved low temperature valve train wear.

BACKGROUND

Automotive manufacturers continue to the push for improved efficiency, fluid longevity, and fuel economy, and as such, demands on engines, lubricants, and their components continue to increase. Today's engines are often smaller, lighter and more efficient with technologies designed to improve fuel economy, performance, and power. These requirements also mean engine oil performance must evolve to meet the higher demands of such modern engines and their corresponding performance criteria tied to their unique use and applications. With such exacting demands for engine oils, lubricant manufacturers often tailor lubricants and their additives to meet certain performance requirements for industry and/or manufacturer applications.

Typically, industry standards and/or automotive manufacturers require certain performance such that a lubricant designed for one use or application may not satisfy all the specifications for a different use or application. Modern automotive and/or industry standards are placing increasingly stringent requirements in terms composition and performance of such oils, which often leaves little room for lubricant formulation flexibility. For instance, the Society of Automotive Engineers (SAE) or the Japanese Automobile Standards Organization (JASO) set performance standards of lubricants for use in a wide range of applications.

One of the targets in lubricant development has been to aid in improving fuel efficiency by means of reducing frictional losses, which is often targeted by designing lubricants with lower viscosity. However, as lubricant manufacturers strive to meet more stringent industry standards, it becomes a challenge to cost effectively achieve all the needed performance and automotive industry standards at the same time. In many circumstances varying components within a lubricant composition to satisfy newer performance characteristics tends to negatively impact one or more other performance characteristics. Thus, it becomes challenging for the lubricant manufacturer to meet newer industry performance demands while also maintaining traditional fluid performance at the same time.

For instance, molybdenum-based compounds are widely used as a friction modifier and, in some instances, aide in achieving passing performance in motored friction tests, such as for example, the JASO M 365 motored friction test of the JASO GLV-1 specifications. However, when formulating lower viscosity grade lubricants, such as 0W-8, 0W-12, 0W-16, or 0W-20 lubricants, with levels of molybdenum to achieve passing motored friction performance, it becomes difficult to also achieve passing performance on the Sequence IVB Engine test of ASTM D8350 that evaluates the effect of the lubricant on tappet wear for engines with direct-acting overhead cam valve trains.

SUMMARY

The present disclosure relates to lubricating compositions for an engine oil composition providing improved low temperature valve train wear pursuant to the Sequence IVB engine test of ASTM D8350. In one aspect, the engine oil lubricating composition includes one or more base oils of lubricating viscosity, about 300 to about 1000 ppm molybdenum from an oil-soluble molybdenum compound, one or more metal-containing detergents providing greater than about 5 TBN to the lubricating oil composition (wherein the TBN is measured using ASTM D4739), and wherein at least one of the one or more metal-containing detergents comprises an overbased magnesium detergent providing greater than about 2 TBN to the lubricating oil composition (wherein the TBN is measured using ASTM D4739). In embodiment, the engine oil lubricating composition may also include less than about 0.2 weight percent of a polymeric pour point depressant and wherein the engine oil composition has a viscosity grade according to SAE J 300 of 0W-8, 0W-12, 0W-16, or 0W-20.

In other embodiments or approaches, the lubricating composition of the previous paragraph may include optional features or embodiments in any combination. These optional features or embodiment may include one or more of the following: wherein the one or more overbased magnesium-containing detergent includes a magnesium sulfonate; and/or wherein the lubricating oil composition further includes a calcium-containing detergent; and/or wherein the one or more overbased magnesium-containing detergent has a total base number (TBN) of at least about 250 mg KOH/g; and/or wherein the polymeric pour point depressant is a poly(meth) acrylate-based pour point depressant; and/or wherein the polymeric pour point depressant is a poly(meth)acrylate copolymer having monomer units including (i) one or more monomer units selected from C1 to C16 (meth)acrylates and (2) vinyl pyrrolidone monomer units; and/or wherein the engine lubricating oil composition is substantially free of poly(meth)acrylate-based dispersant pour point depressants; and/or wherein the lubricating oil composition lubricates a hybrid gasoline-electric engine; and/or wherein the hybrid gasoline electric engine includes a 2.0 liter or smaller gasoline engine; and/or wherein the lubricating oil composition exhibits an average intake lifter volume loss of 2.7 $mm^3$ or less and a maximum end-of-test iron content of 400 ppm or less when measured pursuant to the sequence IVB engine test of ASTM D8350.

In other approaches or embodiments, a method of lubricating a hybrid gasoline-electric engine to achieve improved low temperature valve train wear pursuant to the Sequence IVB engine test of ASTM D8350 is described herein. In one aspect, the method includes lubricating a hybrid electric-gasoline engine with a lubricating oil composition having a viscosity grade according to SAE J 300 of 0W-8, 0W-12, 0W-16, or 0W-20; and wherein the lubricating oil composition includes one or more base oils of lubricating viscosity; about 300 to about 1000 ppm molybdenum from an oil-soluble molybdenum compound; one or more metal-containing detergent providing greater than about 5 TBN to the lubricating oil composition, wherein TBN is measured using ASTM D4739; wherein the at least one of the one or more metal-containing detergent comprises an overbased magnesium detergent providing greater than about 2 TBN to the lubricating oil composition, wherein the TBN is measured using ASTM D4739; and less than about 0.2 weight percent of a polymeric pour point depressant.

In other approaches or embodiments, the method of the previous paragraph may include optional features, embodiments, or method steps in any combination. These optional features embodiments, or steps may include one or more of the following: the one or more overbased magnesium-containing detergents includes a magnesium sulfonate; and/or wherein the lubricating oil composition further includes a calcium-containing detergent; and/or wherein the one or more overbased magnesium-containing detergents has a total base number (TBN) of at least about 250 mg KOH/g; and/or wherein the polymeric pour point depressant is a poly(meth)acrylate-based pour point depressant; and/or wherein the polymeric pour point depressant is a poly(meth) acrylate copolymer having monomer units including (i) one or more monomer units selected from C1 to C16 (meth) acrylates and (ii) vinyl pyrrolidone monomer units; and/or wherein the lubricating oil composition is substantially free of the poly(meth)acrylate-based pour point depressants; and/or wherein the hybrid gasoline-electric engine includes a 2.0 liter or smaller gasoline engine; and/or wherein the lubricating oil composition exhibits an average intake lifter volume loss of 2.7 $mm^3$ or less and a maximum end-of-test iron content of 400 ppm or less when measured pursuant to the sequence IVB engine test of ASTM D8350; and/or wherein about 40 percent to about 100 percent of the detergent TBN is provided by an overbased magnesium sulfonate.

In yet other embodiments, the present disclosure provides for the use of any embodiment of the lubricant compositions described in this Summary for achieving an average intake lifter volume loss of 2.7 $mm_3$ or less and a maximum end-of-test iron content of 400 ppm or less when measured pursuant to the sequence IVB engine test of ASTM D8350 and when using a viscosity grade according to SAE J 300 of 0W-8, 0W-12, 0W-16, or 0W-20

DETAILED DESCRIPTION

The present disclosure relates to lubricating compositions and methods of lubricating an internal combustion engine effective to maintain passing motored friction performance pursuant to JASO M365 and, at the same time, achieve improved low temperature valve train wear of the Sequence IVB engine test of ASTM D8350. As noted in the Background, low viscosity lubricants, such as 0W-8, 0W-12, 0W-16, or 0W-20 grade lubricants, may be preferred for targeting improved fuel economy, but such low viscosity grade lubricants often require high amounts of molybdenum to achieve the desired motored friction performance. Unfortunately, such high levels of molybdenum cause issues with low viscosity lubricants also passing the valve train wear criteria of the Sequence IVB testing of ASTM D8350.

Surprisingly, lubricating compositions herein achieve passing performance in both performance tests with a boost in overbased magnesium detergent content relative to other fluid and detergent components. As detergents, as well as the soap content from detergents, is largely provided for acid neutralization, detergency, dispersancy, corrosion inhibition, and/or anti-wear, it was unexpected that selection of certain amounts and relationships of detergent metal contribution in the fluids combined with a high molybdenum content would shift a lubricant with a failing Sequence IVB performance into a lubricant with a passing Sequence IVB performance that also achieves desired motor friction performance as well. As used herein, acceptable Sequence IVB performance is an average intake lifter volume loss of 2.7 $mm^3$ or less and a maximum end of test iron content of 400 ppm or less. Any embodiment of the lubricants herein is particularly suited for lubricating a hybrid gasoline-electric engine, and more particularly, a hybrid gasoline-electric engine with a 2.0 liter or smaller gasoline engine.

In one aspect, the lubricants herein all include effective amounts of molybdenum from an oil-soluble molybdenum compound, such as molybdenum dithiocarbamate, to achieve passing motor friction performance of JASO M 365. The lubricants herein also include a detergent system including one or more metal-containing detergents providing greater than about 5 TBN to the lubricating oil composition (wherein the TBN is measured using ASTM D4739) and where at least one of the one or more metal-containing detergents is an overbased magnesium detergent, such as an overbased magnesium sulfonate detergent, providing greater than about 2 TBN to the lubricating oil composition, greater than about 3 TBN to the lubricating oil composition, greater than about 4 TBN to the lubricating oil composition, and more preferably, or than about 5 TBN to the lubricating oil composition from the overbased magnesium detergent. In some approaches, the detergent systems herein may also include a ratio of the TBN provided by the overbased magnesium component relative to the TBN of the full detergent system of at least about 0.4:1 or greater such as about to about 1:1, or about 0.6:1 to about 1:1, or about 0.8:1 to about 1:1. In other approaches, the detergent systems herein have at least about 40 percent of the detergent TBN provided by the overbased magnesium detergent, or about 40 percent to about 100 percent of the TBN, or more preferably about 40 to about 60 percent of the detergent TBN is provided by an overbased magnesium detergent, such as an overbased magnesium sulfonate.

Oil-Soluble Molybdenum Compounds

The lubricants herein include an effective amount of one or more oil soluble molybdenum-containing compounds providing sufficient molybdenum content to achieve passing motor friction tests, such as passing performance pursuant to JASO M365. Effective amounts of molybdenum from the oil-soluble molybdenum as used herein is at least about 300 ppm molybdenum or about 300 ppm to about 1000 ppm, preferably, about 500 ppm to about 1000 ppm, more preferably, about 700 ppm to about 1000 ppm, or most preferably, about 800 ppm to about 1000 ppm of molybdenum from the oil soluble molybdenum compound, such as a molybdenum dithiocarbamate as set forth below.

The oil-soluble molybdenum compound may be any of molybdenum dithiocarbamates, molybdenum dialkyl dithiophosphates, molybdenum sulfides, molybdenum disulfides, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organomolybdenum compound, and/or mixtures thereof. The molybdenum-containing compounds may be sulfur-containing or sulfur-free compounds. The molybdenum disulfide may be in the form of a stable dispersion. Preferably, the oil-soluble molybdenum compound is molybdenum dithiocarbamate or molybdenum dialkyl dithiocarbamate having 1 to 20 carbons in the alkyl chains.

In one embodiment the oil-soluble molybdenum compound may be selected from the group of molybdenum dithiocarbamates, molybdenum dialkyldithiophosphates, sulfur-free organomolybdenum complexes of organic amides, and mixtures thereof. In one embodiment, the oil-soluble molybdenum compound may be a molybdenum dithiocarbamate. Exemplary sulfur-free organomolybdenum complexes of organic amides are disclosed in U.S. Pat. No. 5,137,647.

In one approach or embodiment, suitable molybdenum dithiocarbamates may be represented by the Formula:

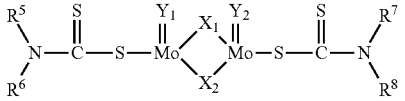

where $R^5$, $R^6$, $R^7$, and $R^8$ are each, independently, a hydrogen atom, a $C_1$ to $C_{20}$ alkyl group, a $C_6$ to $C_{20}$ cycloalkyl, aryl, alkylaryl, or aralkyl group, or a $C_3$ to $C_{20}$ hydrocarbyl group optionally containing an ester, ether, alcohol, or carboxyl group; and $X_1$, $X_2$, $Y_1$, and $Y_2$ are each, independently, a sulfur or oxygen atom. Examples of suitable groups for each of $R^5$, $R^6$, $R^7$, and $R^8$ include 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, linoleyl, cyclohexyl and phenylmethyl. In other approaches, $R^5$, $R^6$, $R^7$, and $R^8$ may each have $C_6$ to $C_{18}$ alkyl groups. $X_1$ and $X_2$ may be the same, and $Y_1$ and $Y_2$ may be the same. $X_1$ and $X_2$ may both comprise sulfur atoms, and $Y_1$ and $Y_2$ may both comprise oxygen atoms. Further examples of molybdenum dithiocarbamates include $C_6$-$C_{18}$ dialkyl or diaryldithiocarbamates, or alkyl-aryldithiocarbamates such as dibutyl-, diamyl-di-(2-ethylhexyl)-, dilauryl-, dioleyl-, and dicyclohexyl-dithiocarbamate.

Suitable examples of molybdenum compounds which may be used include commercial materials sold under the trade names such as Molyvan® 822, Molyvan® A, Molyvan® 2000. Molyvan® 807 and Molyvan® 855 from R. T. Vanderbilt Co., Ltd., and Sakura-Lube™ S-165, S-200, S-300, 5-310G, S-525, S-600, S-700, and S-710 available from Adeka Corporation, and mixtures thereof. Suitable molybdenum components are described in U.S. Pat. No. 5,650,381; RE 37,363 E1; RE 38,929 E1; and RE 40,595 E1, incorporated herein by reference in their entireties.

The Detergent System

As noted above, with such high levels of molybdenum, prior low viscosity lubricants tended to fail the Sequence IVB low temperature valve train wear tests of ASTM D8350. The lubricating compositions herein, on the other hand, include a unique detergent system providing select amounts and relationships of magnesium, and preferably, overbased magnesium sulfonate, that aids in achieving the low temperature valve train wear when combined with high levels of molybdenum from the oil-soluble molybdenum compounds in low viscosity lubricants.

In embodiments, the detergent system herein generally includes detergent additives such as one or more alkali or alkaline metal salts of phenates, sulfonates, calixarates, salixarates, salicylates, carboxylic acids, sulfurized derivatives thereof, or combinations thereof so long as the magnesium amounts and TBN relationships herein are satisfied. Preferably, the detergents are sulfonates, and most preferably including at least one overbased magnesium sulfonate having the soap, metal, and/or TBN relationships discovered herein.

Suitable detergents and their methods of preparation are described in greater detail in numerous patent publications, including U.S. Pat. No. 7,732,390 and references cited therein, which are incorporated herein by reference. The lubricant compositions herein may include about 0.1 to about 5 weight percent of individual and/or total detergent additives, and in other approaches, about 0.15 to about 3 weight percent, and in yet other approaches, about 0.15 to 2.6 weight percent of individual and/or total detergent additives so long as the detergent additives meet the metal amounts and TBN relationships noted herein.

As noted above and in some approaches, the detergent system provides select amounts of detergent metals and TBN from the detergent soaps, and in other approaches, select amounts and relationships of magnesium and, preferably, magnesium and calcium provided by a sulfonate soap where the detergent includes a minimum amount of magnesium such that the magnesium detergent contribution provides at least about 40 percent of the detergent TBN in the fluid as measured pursuant to ASTM D 4739. As noted above, the detergent systems herein may include a ratio of the TBN provided by the overbased magnesium component relative to the TBN of the full detergent system of at least about 0.4:1 or greater such as about 0.4:1 to about 1:1, or about 0.6:1 to about 1:1, or about 0.8:1 to about 1:1. In other approaches, the detergent systems herein have at least about 40 percent of the detergent TBN provided by the overbased magnesium detergent, or about 40 percent to about 100 percent of the TBN, or more preferably about 40 to about 60 percent of the detergent TBN is provided by an overbased magnesium detergent, such as an overbased magnesium sulfonate.

For instance, the detergent system provides an amount of total detergent metals that is greater than about 1000 ppm total metal based on the total lubricating composition, and in other approaches, about 1000 ppm to about 5000 ppm total metals, about 1200 ppm to about 3500 ppm total metal, about 1400 to about 3000 ppm total metal, or about 1500 ppm to about 2500 ppm total metals. In other approaches, the detergent metals are calcium, sodium and/or magnesium and preferably, calcium and magnesium provided by sulfonates and, more preferably, overbased calcium and overbased magnesium sulfonates. The detergents may also optionally include calcium phenates as well and/or other detergent as needed for a particular application so long as the noted amounts of metals and detergent TBN relationships are satisfied. More specifically, the detergent systems herein include neutral to overbased detergents (preferably, neutral to overbased calcium sulfonate, neutral to overbased sodium sulfonate, and/or neutral to overbased magnesium sulfonate) providing about 300 to about 600 ppm of magnesium (preferably, about 400 ppm to 600 ppm, or more preferably, about 500 ppm to 600 ppm of magnesium) and in some embodiments at least about 500 ppm of calcium (preferably about 500 ppm to about 2,000 ppm of calcium or about 1000 ppm to about 1500 ppm of calcium). In approaches or embodiments, the detergent systems herein may also include specific weight relationships of calcium-to-magnesium of at least about 2 (i.e., at least about 2:1), at least about 2.1, at least about 2.2, or at least about 2.3 (in other approaches, about 2 to about 3.0, about 2.1 to about 2.5, about 2.2 to about 2.5, or about 2.3 to about 2.5).

In yet another approach or embodiment, the detergent system may also provide a certain amount of magnesium relative to the molybdenum from the oil-soluble molybdenum component to achieve passing motor friction performance and passing sequence IVB performance. In one embodiment, a weight relationship of magnesium-to-molybdenum aiding to achieve such dual performance may be about 0.8:1 or less, about 0.6:1 or less or about 0.3:1 to about 0.8:1.

Generally, suitable detergents in the system may include linear or branched alkali or alkaline earth metal salts, such as calcium, sodium, or magnesium, of petroleum sulfonic acids and long chain mono- or di-alkylaryl sulfonic acids with the aryl group being benzyl, tolyl, and xylyl and/or various phenates or derivatives of phenates. Examples of suitable detergents include, but are not limited to, low-based/neutral and overbased variations of the following detergents: calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

The detergent additives may be neutral, low-based, or overbased and, preferably, overbased as noted above. As understood, overbased detergent additives are well-known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The term "overbased" relates to metal salts, such as metal salts of sulfonates, carboxylates, salicylates and/or phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the MR is one and in an overbased salt, MR, is greater than one. They are commonly referred to as overbased, hyperbased, or superbased salts and may be salts of organic sulfur acids, carboxylic acids, or phenols.

As used herein, the term "TBN" is used to denote the Total Base Number in mg KOH/g as measured by the method of ASTM D4739. An overbased detergent of the lubricating oil compositions herein may have a total base number (TBN) of about 200 mg KOH/gram or greater, or about 250 mg KOH/gram or greater, or about 350 mg KOH/gram or greater, or about 375 mg KOH/gram or greater, or about 400 mg KOH/gram or greater. The overbased detergent may have a metal to substrate ratio of from 1.1:1 or less, or from 2:1 or less, or from 4:1 or less, or from 5:1 or less, or from 7:1 or less, or from 10:1 or less, or from 12:1 or less, or from 15:1 or less, or from 20:1 or less.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols. Preferably, the detergents are overbased calcium and magnesium sulfonates.

Optionally, when a low-based or neutral detergent is incorporated into the detergent system, it generally has a TBN of up to 175 mg KOH/g, up to 150 mg KOH/g, up to 100 mg KOH/g, or up to 50 mg KOH/g. The low-based/neutral detergent may include a calcium or magnesium-containing detergent. Examples of suitable low-based/neutral detergent include, but are not limited to, calcium sulfonates, calcium phenates, calcium salicylates, magnesium sulfonates, magnesium phenates, and/or magnesium salicylates.

In some embodiments, the detergent used in the lubricants herein include one or more of an overbased calcium sulfonate, an overbased sodium sulfonate, or an overbased magnesium sulfonate (optionally including overbased metal phenates as well) with each having a total base number of 150 to 500 and, in other approaches, about 200 to about 450, or about 300 to about 425. The above described TBN values reflect those of finished detergent components that have been diluted in a base oil. As noted above, the detergent systems herein preferably include overbased calcium sulfonates and overbased magnesium sulfonates providing the detergent metals and TBN relationships herein.

In other embodiments, the TBN of the detergents herein may reflect a neat or non-diluted version of the detergent component. For example, the fluids herein may include overbased calcium or sodium sulfonate as a neat additive having a TBN of about 300 to about 450, and in other approaches, about 380 to about 420, and/or overbased magnesium sulfonate as a neat additive having a TBN of about 500 to about 700, and in other approaches, about 600 to about 700.

In yet other embodiments, the lubricating compositions herein include certain amounts of the sodium sulfonate, magnesium sulfonate, and/or calcium sulfonate to achieve the metal amounts and relationships noted above. The lubricating compositions may also include about 0 to about 5 weight percent of any detergent, individually, or combined. Other detergents may also be included as needed for a particular application so long as the magnesium, sodium, and calcium amounts and relationships are satisfied.

The detergent systems herein also provide select levels of soap content, particularly a sulfonate soap content, to the lubricant composition and the provided soap amounts are balanced with the level of metal to the desired performance. By one approach, the detergent provides about 0.2 weight percent to about 1.0 weight percent soap content to the final lubricating composition, and in other approaches, the detergent system provides about 0.2 weight percent to about 0.8 weight percent soap content, about 0.25 weight percent to about 0.7 weight percent soap content or about 0.28 weight percent to about 0.6 weight percent soap content, and in yet other approaches, about 0.4 to about 0.6 weight percent soap content providing the calcium, sodium, and/or magnesium metals as described hereinabove (preferably, the soap content is sulfonate soap). In some approaches, the detergent systems may also include an optional phenate soap content, and if included, it may be provided in amounts up to about 0.7 weight percent, or up to about 0.1 weight percent (or any ranges therein).

Soap content generally refers to the amount of neutral organic acid salt and reflects a detergent's cleansing ability, or detergency, and dirt suspending ability. The soap content of a lubricant can be determined by ASTM D3712 and/or the following formula, using an exemplary calcium sulfonate detergent represented by $(RSO_3)_vCa_w(CO_3)_x(OH)_y$ with v, w, x, and y denoting the number of sulfonate groups, the number of calcium atoms, the number of carbonate groups, and the number of hydroxyl groups respectively:

$$\text{soap content} = \frac{\text{formula weight of } [(RSO_3)_2Ca]}{\text{effective formula weight}} \times 100$$

wherein effective formula weight is the combined weight of all the atoms that make up the formula $(RSO_3)_vCa_w(CO_3)_x(OH)_y$ plus that of any other lubricant components. Further discussion on determining soap content can be found in FUELS AND LUBRICANTS HANDBOOK, TECHNOLOGY, PROPERTIES, PERFORMANCE, AND TESTING, George Totten, editor, ASTM International, 2003, relevant portions thereof incorporated herein by reference.

As shown in the Examples below, lubricants meeting such detergent system contributions described above surprisingly achieve passing motored friction and valve train wear performance.

Polymeric Pour Point Additive

In another aspect, the lubricants herein include low amounts of polymeric pour point additives that have been found to adversely impact the low temperature valve train wear in low viscosity lubricants. In an approach or embodiment, for instance, the lubricants herein may also include less than about 0.2 weight percent of polymeric pour point depressants, preferably less than about 0.1 weight percent, more preferably, less than about 0.05 weight percent, or no polymeric pour point depressants. In some approaches, the lubricants herein are substantially free of any embodiment of polymeric pour point depressant as described herein. In such context, the lubricant may have less than about 0.1 weight percent, less than about 0.05 weight percent, or no functional amounts of the pour point depressants. In one exemplary approach, the polymeric pour point additives is a poly(meth) acrylate copolymer including one or more (meth)acrylate monomer units and/or one or more optional heterocyclic-based monomer units derived from monomers including vinyl lactones, vinyl lactams, combinations thereof.

In embodiments, the polymeric pour point additive may have the structure of Formula I below with z and p being integers sufficient to achieve a weight average molecular weight of about 20,000 to about 1,500,00 (in other approaches, about 100,000 to about 500,000, or about 200,000 to about 450,000, or about 200,000 to about 300,000). The p monomer units may provide about 0 to about 10 weight percent of the copolymer, more preferably, about 0.2 to about 5 weight percent, or about 1 to about 4 weight percent of the copolymer. In Formula I, R is hydrogen if the monomer unit is an acrylate and a methyl group if the monomer unit is a methacrylate, R' is a liner or branched hydrocarbyl group sized to achieve any arm molecular weights as described herein, and R" is a heterocyclic moiety derived from monomers such as vinyl lactones, vinyl lactams, combinations thereof, or derivatives thereof and, in some approaches, may include hererocylic moieties derived from vinyl pyrrolidone, vinyl pyridine, N-vinyl pyrrolidone, N-vinylimidazole, N-vinyl caprolactam, combination thereof, or derivatives thereof:

(Formula I)

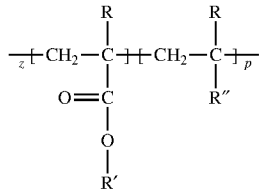

The polymeric copolymers herein may have the varying monomer units randomly spaced throughout the polymer as described below.

Monomers or reactants suitable to form this copolymer may include at least one, and optionally, a blend of at least two distinct monomers or reactants selected from: (1) (meth) acrylate monomers with a low to intermediate weight average molecular weight hydrocarbyl group(s) in the ester moiety of up to about 700, or preferably, about 100 to about 700 or about 400 to about 700 and, optionally (2) (meth) acrylate monomers with a high weight average molecular weight hydrocarbyl groups in the ester moiety of the monomers of about 6,000 to about 10,000 or about 6,000 to about 8,000; and/or optionally (3) monomer units with a heterocyclic moiety derived from monomers such as vinyl lactones, vinyl lactams, combinations thereof. As used herein, "(meth)acrylate" refers to both methacrylate and/or acrylate monomers or monomer units (or mixtures). As also used herein, molecular weight of any ester hydrocarbyl groups in the monomer includes the hydrocarbyl chain as well as the ester oxygen, but does not include the carbonyl group.

Typically, the formed or resultant poly(meth)acrylate copolymers have monomer amounts effective to achieve a number average molecular weight of the total copolymer of about 20,000 or more, and in some instances, about 250,000 or less or about 225,000 or less, such as about 140,000 to about 240,000 or about 140,000 to about 225,000. The poly(meth)acrylate copolymer may also have a polydispersity index (Mw/Mn) of about 2.8 or less, or about 2.6 or less and, in other approaches, ranging from about 1.8 to about 2.6. In yet other approaches, the copolymers herein may optionally have two differently sized pendant arms and/or have pendant heterocycle groups, and in such context, have a molecular weight ratio between higher and lower molecular weight arms of about 10:1 to about 50:1, in other approaches, about 11:1 to about 30:1, and in yet other approaches, about 12:1 to about 25:1. In other instances, the copolymers herein have a molecular weight ratio between higher and lower molecular weight arms of about 1.5:1 to about 25:1, and in other approaches, about 1.5:1 to about 16:1.

In approaches or embodiments, the poly(meth)acrylate copolymers herein include a reaction product in the form of a linear, random copolymer of select amounts of the low to intermediate molecular weight (meth)acrylate monomers, optional heterocyclic based monomers, and/or optional high molecular weight pendant hydrocarbyl (meth)acrylate monomers. These monomers and monomer units are described more below and include both linear and/or branched hydrocarbyl groups in the respective ester chains and, in some embodiments, form comb-like copolymers with at least one and, optionally, at least the two distinct molecular weight pendant arms.

In embodiments or approaches, the low molecular weight hydrocarbyl (meth)acrylate units or monomers are derived from alkyl (meth)acrylates with a linear or branched hydrocarbyl group in the ester moiety, and preferably a linear or branched alkyl group in the ester moiety, with a total carbon chain length of the monomer ester moiety (including any branching) from 1 to 20 carbons, preferably 6 to 20 carbons, and more preferably, 12 to 16 carbons. An exemplary low molecular weight hydrocarbyl (meth)acrylate monomer may be methyl(meth)acrylate or lauryl (meth)acrylate (that may include a blend of (meth)acrylate monomers or monomer units having alkyl chain lengths ranging from C12 to C16 and, in particular, alkyl chains of 12, 14, and 16 carbons in the blend, of which C12 alkyl (meth)acrylates are the majority). In other embodiments or approaches, the low or intermediate molecular weight hydrocarbyl (meth)acrylate units are derived from hydrocarbyl (meth)acrylate monomers with a hydrocarbyl group or a total hydrocarbyl ester length (including any branching) with a weight average molecular weight of at least about 500 and up to about 700. These molecular weight chains can be derived from olefins or, optionally, macromonomers of polymeric alcohols esterified with (meth)acrylic acid. The macromonomers may be derived from alkenes or alkadienes including ethylene, propylene, butene, butadiene, isoprene, or combinations thereof and have a molecular weight of about 700 or less, such as about 500 to about 700.

In yet other embodiments or approaches, the optional high molecular weight hydrocarbyl (meth)acrylate units or monomer are derived from hydrocarbyl (meth)acrylates with a hydrocarbyl group or a total hydrocarbyl ester length (including any branching) with a weight average molecular weight of at least about 6,000 and up to about 10,000 or about 6,000 to about 8,000. These high molecular weight chains can be derived from macromonomers of polymeric alcohols esterified with (meth)acrylic acid. The macromonomers may be derived from alkenes or alkadienes including ethylene, propylene, butene, butadiene, isoprene, or combinations thereof and have a molecular weight of about or less or about 8,000 or less, such as about 500 to about 10,000, or about 6,000 to about 8,000.

In other optional embodiments, the polymeric copolymers herein may also include other optional monomers and monomer units including, for instance, hydroxyalkyl (meth) acrylate and/or various dispersant monomers and monomer units. The poly(meth) acrylate copolymers herein may also optionally be functionalized with one or more dispersant monomer or monomer units. For example, the copolymer may include a heterocyclic moiety derived from monomers such as vinyl lactones, vinyl lactams, combinations thereof, or derivatives thereof and, in some approaches, may include hererocylic moieties derived from vinyl pyrrolidone, vinyl pyridine, N-vinyl pyrrolidone, N-vinylimidazole, N-vinyl caprolactam, combination thereof, or derivatives thereof.

In one optional approach, a dispersant monomer or monomer unit may be nitrogen-containing monomers or units thereof. Such monomers, if used, may impart dispersant functionality to the polymer. In some approaches, the nitrogen-containing monomers may be (meth)acrylic monomers such as methacrylates, methacrylamides, and the like. In some approaches, the linkage of the nitrogen-containing moiety to the acrylic moiety may be through a nitrogen atom or alternatively an oxygen atom, in which case the nitrogen of the monomer will be located elsewhere in the monomer. The nitrogen-containing monomer may also be other than a (meth)acrylic monomer, such as vinyl-substituted nitrogen heterocyclic monomers and vinyl substituted amines. Nitrogen-containing monomers include those, for instance, in U.S. Pat. No. 6,331,603. Other suitable dispersant monomers include, but are not limited to, dialkylaminoalkyl acrylates, dialkylaminoalkyl (meth)acrylates, dialkylaminoalkyl acrylamides, dialkylaminoalkyl methacrylamides, N-tertiary alkyl acrylamides, and N-tertiary alkyl methacrylamides, where the alkyl group or aminoalkyl groups may contain, independently, 1 to 8 carbon atoms. For instance, the dispersant monomer may be dimethylaminoethyl(meth) acrylate. The nitrogen-containing monomer may be, for instance, t-butyl acrylamide, dimethylaminopropyl (meth) acrylamide, dimethylaminoethyl methacrylamide, N-vinyl pyrrolidone, N-vinylimidazole, or N-vinyl caprolactam. It may also be a (meth)acrylamide based on any of the aromatic amines disclosed in WO2005/087821 including 4-phenylazoaniline, 4-aminodiphenylamine, 2-aminobenzimidazole, 3-nitroaniline, 4-(4-nitrophenylazo)aniline, N-(4-amino-5-methoxy-2-methyl-phenyl)-benzamide, N-(4-amino-2,5-dimethoxy-phenyl)-benzamide, N-(4-amino-2,5-diethoxy-phenyl)-benzamide, N-(4-amino-phenyl)-benzamide, 4-amino-2-hydroxy-benzoic acid The (meth)acrylate copolymers of the present disclosure are typically synthesized to have a number average molecular weight of about 20,000 or more, in other approaches, about 250,000 or less or about 200,000 or less. Suitable ranges for the number average molecular weights include, about 140,000 to about 250,000, and in other approaches, about 150,000 to about 200,000. Such copolymers herein typically have a polydispersity index ranging from about 1 to about 4, and in other approaches, about 1.2 to about 3.5, and in yet other approaches, about 1.5 to about 3, and in yet other approaches, about 1.6 to about 2.5.

The (meth)acrylate copolymers may be prepared by any suitable conventional or controlled free-radical polymerization technique. Examples include conventional free radical polymerization (FRP), reversible addition-fragmentation chain transfer (RAFT), atom transfer radial polymerization (ATRP), and other controlled types of polymerization known in the art. Polymerization procedures are known to those in the art and include, for instance, the use of common polymerization initiators (such as Vazo™ 67 (2.2'-Azobis (2-methylbutyronitrile), chain transfer agents (such as dodecyl mercaptane) if using conventional FRP, or RAFT agents (such as 4-cyano-4-[(dodecylsulfanylthiocarbonyl) sulfanyl] pentanoic acid and the like) if using RAFT polymerization. Other initiators, chain transfer agents, RAFT agents, ATRP catalyst and initiator systems can be used as known in the art depending on the selected polymerization method as needed for a particular application.

Aminic or Phenolic Antioxidant

The lubricants herein may also include one or more antioxidants and, preferably, one or more aminic or phenolic antioxidants. Similar to the polymeric pour point additive discussed above, the lubricants herein include low amounts of aminic and/or phenolic antioxidant that have been found to adversely impact the low temperature valve train wear in low viscosity lubricants. In approaches or embodiments, the aminic antioxidants may include, but are not limited to, antioxidants selected from aromatic amines, alkylated diphenylamines, phenyl-α-napthylamines, alkylated phenyl-α-naphthylamines, hindered non-aromatic amines, and the like, or combinations thereof. The total amount of antioxidant in the lubricating compositions herein, for instance, may be present in an amount to deliver no more than about 400 ppm nitrogen, or no more than about 300 ppm nitrogen, or no more than about 200 ppm nitrogen, or about 50 to about 400 ppm nitrogen, about 60 to about 300 ppm nitrogen, about 70 to about 200 ppm nitrogen, or about 80 to about 100 ppm nitrogen. In other approaches, the lubricating compositions herein may include no more than about 2 weight percent of the aminic antioxidant, or about 0.1 to about 2.0 weight percent of the aminic antioxidant, in other approaches, about 0.1 to about 1.0 weight percent, or about 0.2 to about 0.8 weight percent, or about 0.2 to about 0.6 weight percent of the aminic antioxidant.

In some approaches, the aminic antioxidant may be one or more aromatic amine antioxidants and may include, but are not limited to, diarylamines having the formula:

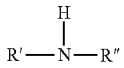

wherein R' and R" each independently represents a substituted or unsubstituted aryl group having from 6 to 30 carbon atoms. If substituted, suitable substituents for the aryl group of R' and R" include aliphatic hydrocarbon groups such as alkyl having from 1 to 30 carbon atoms, hydroxy groups, halogen radicals, carboxylic acid or ester groups, or nitro groups. The aryl group may be substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. In approaches, one or both aryl groups may be substituted, e.g. mono-alkylated diphenylamine, di-alkylated diphenylamine, C9 alkylated diphenyl amines, or mixtures of mono- and di-alkylated diphenylamines.

Examples of diarylamines that may be used include, but are not limited to: diphenylamine; various alkylated diphenylamines, 3-hydroxydiphenylamine, N-phenyl-1,2-phenylenediamine, N-phenyl-1,4-phenylenediamine, monobutyldiphenyl-amine, dibutyl-diphenylamine, monooctyldiphenylamine, dioctyldiphenylamine, monononyl-diphenylamine, dinonyldiphenylamine, monotetradecyldiphenylamine, ditetradecyl-diphenylamine, phenyl-alpha-naphthylamine, monooctyl phenyl-alpha-naphthylamine, phenyl-beta-naphthylamine, monoheptyldiphenylamine, diheptyl-diphenylamine, p-oriented styrenated diphenylamine, mixed butyloctyldiphenylamine, and mixed octylstyryl-diphenylamine.

In other approaches, suitable antioxidants may include aromatic amine antioxidants. Examples of phenolic antioxidants include N,N'-di-sec-butyl-phenylene-diamine, 4-iisopropylamino diphenylamine, phenyl-alpha-naphthyl amine, phenyl-alpha-naphthyl amine, and ring-alkylated diphenylamines.

Base Oil or Base Oil Blend:

The base oil used in the lubricating compositions herein may be oils of lubricating viscosity and selected from any of the base oils in API Groups I to V as specified in the American Petroleum Institute (API) Base Oil Interchangeability Guidelines. The five base oil groups are generally set forth in Table 1 below:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |

TABLE 1-continued

| Base oil Category | Sulfur (%) | | Saturates (%) | Viscosity Index |
|---|---|---|---|---|
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Group II+ may comprise high viscosity index Group II.

The base oil blend used in the disclosed lubricating oil composition may be a mineral oil, animal oil, vegetable oil, synthetic oil, synthetic oil blends, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propylene-isobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)- benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The major amount of base oil included in a lubricating composition may be selected from the group consisting of Group I, Group II, a Group III, a Group IV, a Group V, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group II, a Group III, a Group IV, a Group V, and a combination of two or more of the foregoing, and wherein the major amount of base oil is other than base oils that arise from provision of additive components or viscosity index improvers in the composition.

The amount of the oil of lubricating viscosity present may be the balance remaining after subtracting from 100 wt % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt %, greater than about wt %, greater than about 70 wt %, greater than about 80 wt %, greater than about 85 wt %, or greater than about 90 wt %.

The base oil systems herein, in some approaches or embodiments, include one or more of a Group I to Group V base oils and may have a KV100 of about 2 to about 20 cSt, in other approaches, about 2 to about 10 cSt, about 2.5 to about 6 cSt, in yet other approaches, about 2.5 to about 3.5 cSt, and in other approaches about 2.5 to about 4.5 cSt.

As used herein, the terms "oil composition," "lubrication composition," "lubricating oil composition," "lubricating oil," "lubricant composition," "fully formulated lubricant composition," "lubricant," and "lubricating and cooling fluid" are considered synonymous, fully interchangeable terminology referring to the finished lubrication product comprising a major amount of a base oil component plus minor amounts of the detergents and the other optional components.

Optional Additives:

The lubricating oil compositions herein may also include a number of optional additives combined with the detergent systems, sulfurized additives, and boronated detergents as needed to meet performance standards. Those optional additives are described in the following paragraphs.

Dispersants:

The lubricating oil composition may optionally include one or more dispersants or mixtures thereof. Dispersants are often known as ashless-type dispersants because, prior to mixing in a lubricating oil composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with the number average molecular weight of the polyisobutylene substituent being in the range about 350 to about 50,000, or to about 5,000, or to about 3,000, as measured by GPC. Succinimide dispersants and their preparation are disclosed, for instance in U.S. Pat. No. 7,897,696 or U.S. Pat. No. 4,234,435. The alkenyl substituent may be prepared from polymerizable monomers containing about 2 to about 16, or about 2 to about 8, or about 2 to about 6 carbon atoms. Succinimide dispersants are typically the imide formed from a polyamine, typically a poly(ethyleneamine).

Preferred amines are selected from polyamines and hydroxyamines. Examples of polyamines that may be used include, but are not limited to, diethylene triamine (DETA), triethylene tetramine (TETA), tetraethylene pentamine (TEPA), and higher homologues such as pentaethylamine hexamine (PEHA), and the like.

A suitable heavy polyamine is a mixture of polyalkylenepolyamines comprising small amounts of lower polyamine oligomers such as TEPA and PEHA (pentaethylene hexamine) but primarily oligomers with 6 or more nitrogen atoms, 2 or more primary amines per molecule, and more extensive branching than conventional polyamine mixtures. A heavy polyamine preferably includes polyamine oligomers containing 7 or more nitrogens per molecule and with 2 or more primary amines per molecule. The heavy polyamine comprises more than 28 wt. % (e.g. >32 wt. %) total nitrogen and an equivalent weight of primary amine groups of 120-160 grams per equivalent.

In some approaches, suitable polyamines are commonly known as PAM and contain a mixture of ethylene amines where TEPA and pentaethylene hexamine (PEHA) are the major part of the polyamine, usually less than about 80%.

Typically, PAM has 8.7-8.9 milliequivalents of primary amine per gram (an equivalent weight of 115 to 112 grams per equivalent of primary amine) and a total nitrogen content of about 33-34 wt. %. Heavier cuts of PAM oligomers with practically no TEPA and only very small amounts of PEHA but containing primarily oligomers with more than 6 nitrogens and more extensive branching, may produce dispersants with improved dispersancy.

In an embodiment the present disclosure further comprises at least one polyisobutylene succinimide dispersant derived from polyisobutylene with a number average molecular weight in the range about 350 to about 50,000, or to about 5000, or to about 3000, as determined by GPC. The polyisobutylene succinimide may be used alone or in combination with other dispersants.

In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000, as determined by GPC, is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000 may be suitable, as determined by GPC. Such HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

In one embodiment, the present disclosure further comprises at least one dispersant derived from polyisobutylene succinic anhydride ("PIBSA"). The PIBSA may have an average of between about 1.0 and about 2.0 succinic acid moieties per polymer.

The % actives of the alkenyl or alkyl succinic anhydride can be determined using a chromatographic technique. This method is described in column 5 and 6 in U.S. Pat. No. 5,334,321.

The percent conversion of the polyolefin is calculated from the % actives using the equation in column 5 and 6 in U.S. Pat. No. 5,334,321.

Unless stated otherwise, all percentages are in weight percent and all molecular weights are number average molecular weights determined by gel permeation chromatography (GPC) using commercially available polystyrene standards (with a number average molecular weight of 180 to about 18,000 as the calibration reference).

In one embodiment, the dispersant may be derived from a polyalphaolefin (PAO) succinic anhydride. In one embodiment, the dispersant may be derived from olefin maleic anhydride copolymer. As an example, the dispersant may be described as a poly-PIBSA. In an embodiment, the dispersant may be derived from an anhydride which is grafted to an ethylene-propylene copolymer.

A suitable class of nitrogen-containing dispersants may be derived from olefin copolymers (OCP), more specifically, ethylene-propylene dispersants which may be grafted with maleic anhydride. A more complete list of nitrogen-containing compounds that can be reacted with the functionalized OCP are described in U.S. Pat. Nos. 7,485,603; 7,786,057; 7,253,231; 6,107,257; and 5,075,383; and/or are commercially available.

One class of suitable dispersants may also be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may also be high molecular weight esters or half ester amides. A suitable dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 are incorporated herein by reference in their entireties.

In addition to the carbonate and boric acids post-treatments both the compounds may be post-treated, or further post-treatment, with a variety of post-treatments designed to improve or impart different properties. Such post-treatments include those summarized in columns 27-29 of U.S. Pat. No. 5,241,003, hereby incorporated by reference. Such treatments include, treatment with: Inorganic phosphorous acids or anhydrates (e.g., U.S. Pat. Nos. 3,403,102 and 4,648,980); Organic phosphorous compounds (e.g., U.S. Pat. No. 3,502,677); Phosphorous pentasulfides; Boron compounds as already noted above (e.g., U.S. Pat. Nos. 3,178,663 and 4,652,387); Carboxylic acid, polycarboxylic acids, anhydrides and/or acid halides (e.g., U.S. Pat. Nos. 3,708,522 and 4,948,386); Epoxides polyepoxiates or thioexpoxides (e.g., U.S. Pat. Nos. 3,859,318 and 5,026,495); Aldehyde or ketone (e.g., U.S. Pat. No. 3,458,530); Carbon disulfide (e.g., U.S. Pat. No. 3,256,185); Glycidol (e.g., U.S. Pat. No. 4,617,137); Urea, thiourea or guanidine (e.g., U.S. Pat. Nos. 3,312,619; 3,865,813; and British Patent GB 1,065,595); Organic sulfonic acid (e.g., U.S. Pat. No. 3,189,544 and British Patent GB 2,140,811); Alkenyl cyanide (e.g., U.S. Pat. Nos. 3,278,550 and 3,366,569); Diketene (e.g., U.S. Pat. No. 3,546,243); A diisocyanate (e.g., U.S. Pat. No. 3,573,205); Alkane sultone (e.g., U.S. Pat. No. 3,749,695); 1,3-Dicarbonyl Compound (e.g., U.S. Pat. No. 4,579,675); Sulfate of alkoxylated alcohol or phenol (e.g., U.S. Pat. No. 3,954,639); Cyclic lactone (e.g., U.S. Pat. Nos. 4,617,138; 4,645,515; 4,668,246; 4,963,275; and 4,971,711); Cyclic carbonate or thiocarbonate linear monocarbonate or polycarbonate, or chloroformate (e.g., U.S. Pat. Nos. 4,612,132; 4,647,390; 4,648,886; 4,670,170); Nitrogen-containing carboxylic acid (e.g., U.S. Pat. No. 4,971,598 and British Patent GB 2,140,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603 and 4,666,460); Cyclic carbonate or thiocarbonate, linear monocarbonate or polycarbonate, or chloroformate (e.g., U.S. Pat. Nos. 4,612,132; 4,647,390; 4,646,860; and 4,670,170); Nitrogen-containing carboxylic acid (e.g., U.S. Pat. No. 4,971,598 and British Patent GB 2,440,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603, and 4,666,460); Cyclic carbamate, cyclic thiocarbamate or cyclic dithiocarbamate (e.g., U.S. Pat. Nos. 4,663,062 and 4,666,459); Hydroxyaliphatic carboxylic acid (e.g., U.S. Pat. Nos. 4,482,464; 4,521,318; 4,713,189); Oxidizing agent (e.g., U.S. Pat. No. 4,379,064); Combination of phosphorus pentasulfide and a polyalkylene polyamine (e.g., U.S. Pat. No. 3,185,647); Combination of carboxylic acid or an aldehyde or ketone and sulfur or sulfur chloride (e.g., U.S. Pat. Nos. 3,390,086; 3,470,098); Combination of a hydrazine and carbon disulfide (e.g. U.S. Pat. No. 3,519,564); Combination of an aldehyde and a phenol (e.g., U.S. Pat. Nos. 3,649,229; 5,030,249; 5,039,307); Combination of an aldehyde and an 0-diester of dithiophosphoric acid (e.g., U.S. Pat. No. 3,865,740); Combination of a hydroxyaliphatic carboxylic acid and a boric acid (e.g., U.S. Pat. No. 4,554,086); Combination of a hydroxyaliphatic carboxylic acid, then formaldehyde and a phenol (e.g., U.S. Pat. No. 4,636,322); Combination of a hydroxyaliphatic carboxylic acid and then an aliphatic dicarboxylic acid (e.g., U.S. Pat. No. 4,663,064); Combination of formaldehyde and a phenol and then glycolic acid (e.g., U.S. Pat. No. 4,699,724); Combination of a hydroxyaliphatic carboxylic acid or oxalic acid and then a diisocyanate (e.g. U.S. Pat. No. 4,713,191); Combination of inorganic acid or anhydride of phosphorus or a partial or total sulfur analog thereof and a boron compound (e.g., U.S. Pat. No. 4,857,214); Combination of an organic diacid then an unsaturated fatty acid and then a nitrosoaromatic amine optionally followed by a boron compound and then a glycolating agent (e.g., U.S. Pat. No. 4,973,412); Combination of an aldehyde and a triazole (e.g., U.S. Pat. No. 4,963,278); Combination of an aldehyde and a triazole then a boron compound (e.g., U.S. Pat. No. 4,981,492); Combination of cyclic lactone and a boron compound (e.g., U.S.

Pat. Nos. 4,963,275 and 4,971,711). The above-mentioned patents are herein incorporated in their entireties.

The TBN of a suitable dispersant may be from about 10 to about 65 mg KOH/g dispersant, on an oil-free basis, which is comparable to about 5 to about 30 TBN if measured on a dispersant sample containing about 50% diluent oil. TBN is measured by the method of ASTM D2896.

In yet other embodiments, the optional dispersant additive may be a hydrocarbyl substituted succinamide or succinimide dispersant. In approaches, the hydrocarbyl substituted succinamide or succinimide dispersant may be derived from a hydrocarbyl substituted acylating agent reacted with a polyalkylene polyamine and wherein the hydrocarbyl substituent of the succinamide or the succinimide dispersant is a linear or branched hydrocarbyl group having a number average molecular weight of about 250 to about 5,000 as measured by GPC using polystyrene as a calibration reference.

In some approaches, the polyalkylene polyamine used to form the dispersant has the Formula

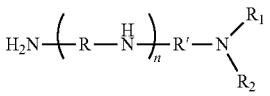

wherein each R and R', independently, is a divalent C1 to C6 alkylene linker, each $R_1$ and $R_2$, independently, is hydrogen, a C1 to C6 alkyl group, or together with the nitrogen atom to which they are attached form a 5- or 6-membered ring optionally fused with one or more aromatic or non-aromatic rings, and n is an integer from 0 to 8. In other approaches, the polyalkylene polyamine is selected from the group consisting of a mixture of polyethylene polyamines having an average of 5 to 7 nitrogen atoms, triethylenetetramine, tetraethylenepentamine, and combinations thereof.

The dispersant, if present, can be used in an amount sufficient to provide up to about 20 wt %, based upon the final weight of the lubricating oil composition. Another amount of the dispersant that can be used may be about 0.1 wt % to about 15 wt %, or about 0.1 wt % to about 10 wt %, about 0.1 to 8 wt %, or about 1 wt % to about 10 wt %, or about 1 wt % to about 8 wt %, or about 1 wt % to about 6 wt %, based upon the final weight of the lubricating oil composition. In some embodiments, the lubricating oil composition utilizes a mixed dispersant system. A single type or a mixture of two or more types of dispersants in any desired ratio may be used.

Antioxidants:

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox™ 4716 available from Albemarle Corporation.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight, based upon the final weight of the lubricating oil composition. In an embodiment, the antioxidant may be a mixture of about 0.3 to about 1.5% diarylamine and about 0.4 to about 2.5% high molecular weight phenol, by weight, based upon the final weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

In another alternative embodiment the antioxidant composition also contains a molybdenum-containing antioxidant in addition to the phenolic and/or aminic antioxidants discussed above. When a combination of these three antioxidants is used, preferably the ratio of phenolic to aminic to molybdenum-containing component treat rates is (0 to 3):(0 to 3):(0 to 3).

The one or more antioxidant(s) may be present in ranges about 0 wt % to about 20 wt %, or about 0.1 wt % to about 10 wt %, or about 1 wt % to about 5 wt %, of the lubricating oil composition.

Antiwear Agents:

The lubricating oil compositions herein also may optionally contain one or more antiwear agents. Examples of suitable antiwear agents include, but are not limited to, a metal thiophosphate; a metal dialkyldithiophosphate; a phosphoric acid ester or salt thereof a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. A suitable antiwear agent may be a molybdenum dithiocarbamate. The phosphorus containing antiwear agents are more fully described in European Patent 612 839. The metal in the dialkyl dithio phosphate salts may be an alkali metal, alkaline earth metal, aluminum, lead, tin, molybdenum, manganese, nickel, copper, titanium, or zinc. A useful antiwear agent may be zinc dialkyldithiophosphate.

Further examples of suitable antiwear agents include titanium compounds, tartrates, tartrimides, oil soluble amine salts of phosphorus compounds, sulfurized olefins, phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The tartrate or tartrimide may contain alkyl-ester groups, where the sum of carbon atoms on the alkyl groups may be at least 8. The antiwear agent may in one embodiment include a citrate.

The antiwear agent may be present in ranges including about 0 wt % to about 15 wt %, or about 0.01 wt % to about 10 wt %, or about 0.05 wt % to about 5 wt %, or about 0.1 wt % to about 3 wt % of the lubricating oil composition.

Boron-Containing Compounds:

The lubricating oil compositions herein may optionally contain one or more boron-containing compounds. Examples of boron-containing compounds include borate esters, borated fatty amines, borated epoxides, borated detergents, and borated dispersants, such as borated succinimide dispersants, as disclosed in U.S. Pat. No. 5,883,057. The boron-containing compound, if present, can be used in an amount sufficient to provide up to about 8 wt %, about 0.01 wt % to about 7 wt %, about 0.05 wt % to about 5 wt %, or about 0.1 wt % to about 3 wt % of the lubricating oil composition.

Additional Detergents:

The lubricating oil composition may optionally further comprise one or more neutral, low based, or overbased detergents, and mixtures thereof. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein.

The detergent substrate may be salted with an alkali or alkaline earth metal such as, but not limited to, calcium, magnesium, potassium, sodium, lithium, barium, or mixtures thereof. In some embodiments, the detergent is free of barium. In some embodiments, a detergent may contain traces of other metals such as magnesium or calcium in amounts such as 50 ppm or less, 40 ppm or less, 30 ppm or less, 20 ppm or less, or 10 ppm or less. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

An overbased detergent of the lubricating oil composition may have a total base number (TBN) of about 200 mg KOH/g or greater, or as further examples, about 250 mg KOH/g or greater, or about 350 mg KOH/g or greater, or about 375 mg KOH/g or greater, or about 400 mg KOH/g or greater. The TBN being measured by the method of ASTM D2896.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased calcium phenate detergents have a total base number of at least about 150 mg KOH/g, at least about 225 mg KOH/g, at least about 225 mg KOH/g to about 400 mg KOH/g, at least about 225 mg KOH/g to about 350 mg KOH/g or about 230 mg KOH/g to about 350 mg KOH/g, all as measured by the method of ASTM D2896. When such detergent compositions are formed in an inert diluent, e.g. a process oil, usually a mineral oil, the total base number reflects the basicity of the overall composition including diluent, and any other materials (e.g., promoter, etc.) that may be contained in the detergent composition.

The overbased detergent may have a metal to substrate ratio of from 1.1:1, or from 2:1, or from 4:1, or from 5:1, or from 7:1, or from 10:1. In some embodiments, a detergent is effective at reducing or preventing rust in an engine or other automotive part such as a transmission or gear. The detergent may be present in a lubricating composition at about 0 wt % to about 10 wt %, or about 0.1 wt % to about 8 wt %, or about 1 wt % to about 4 wt %, or greater than about 4 wt % to about 8 wt %.

Extreme Pressure Agents:

The lubricating oil compositions herein also may optionally contain one or more extreme pressure agents. Extreme Pressure (EP) agents that are soluble in the oil include sulfur- and chlorosulfur-containing EP agents, chlorinated hydrocarbon EP agents and phosphorus EP agents. Examples of such EP agents include chlorinated wax; organic sulfides and polysulfides such as dibenzyldisulfide, bis(chlorobenzyl) disulfide, dibutyl tetrasulfide, sulfurized methyl ester of oleic acid, sulfurized alkyl phenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Friction Modifiers:

The lubricating oil compositions herein also may optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685, herein incorporated by reference in its entirety.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference in its entirety.

A friction modifier may optionally be present in ranges such as about 0 wt % to about 10 wt %, or about 0.01 wt % to about 8 wt %, or about 0.1 wt % to about 4 wt %.

Molybdenum-containing component:

The lubricating oil compositions herein also may optionally contain one or more molybdenum-containing compounds. An oil-soluble molybdenum compound may have the functional performance of an antiwear agent, an antioxidant, a friction modifier, or mixtures thereof. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound may be a molybdenum dithiocarbamate.

Suitable examples of molybdenum compounds which may be used include commercial materials sold under the trade names such as Molyvan® 822, Molyvan® A, Molyvan® 2000 and Molyvan® 855 from R. T. Vanderbilt Co., Ltd., and Adeka Sakura-Lube® S-165, S-200, S-300, S-310G, S-525, S-600, S-700, and S-710 available from Adeka Corporation, and mixtures thereof. Suitable molybdenum components are described in U.S. Pat. No. 5,650,381; US RE 37,363 E1; US RE 38,929 E1; and US RE 40,595 E1, incorporated herein by reference in their entireties.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897, incorporated herein by reference in their entireties.

Another class of suitable organo-molybdenum compounds are trinuclear molybdenum compounds, such as those of the formula $Mo_3S_kL_nQ_z$ and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference in its entirety.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum.

Transition Metal-Containing Compounds:

In another embodiment, the oil-soluble compound may be a transition metal containing compound or a metalloid. The transition metals may include, but are not limited to, titanium, vanadium, copper, zinc, zirconium, molybdenum, tantalum, tungsten, and the like. Suitable metalloids include, but are not limited to, boron, silicon, antimony, tellurium, and the like.

In an embodiment, an oil-soluble transition metal-containing compound may function as antiwear agents, friction modifiers, antioxidants, deposit control additives, or more than one of these functions. In an embodiment the oil-soluble transition metal-containing compound may be an oil-soluble titanium compound, such as a titanium (IV) alkoxide. Among the titanium containing compounds that may be used in, or which may be used for preparation of the oils-soluble materials of, the disclosed technology are various Ti (IV) compounds such as titanium (IV) oxide; titanium (IV) sulfide; titanium (IV) nitrate; titanium (IV) alkoxides such as titanium methoxide, titanium ethoxide, titanium propoxide, titanium isopropoxide, titanium butoxide, titanium 2-ethylhexoxide; and other titanium compounds or complexes including but not limited to titanium phenates; titanium carboxylates such as titanium (IV) 2-ethyl-1-3-hexanedioate or titanium citrate or titanium oleate; and titanium (IV) (triethanolaminato)isopropoxide. Other forms of titanium encompassed within the disclosed technology include titanium phosphates such as titanium dithiophosphates (e.g., dialkyldithiophosphates) and titanium sulfonates (e.g., alkylbenzenesulfonates), or, generally, the reaction product of titanium compounds with various acid materials to form salts, such as oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In one embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl- (or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl- (or alkyl-) succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with about 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 grams+diluent oil) at 150° C. for 1.5 hours, to produce a titanium-modified succinimide dispersant.

Another titanium containing compound may be a reaction product of titanium alkoxide and C6 to C25 carboxylic acid. The reaction product may be represented by the following formula:

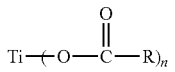

wherein n is an integer selected from 2, 3 and 4, and R is a hydrocarbyl group containing from about 5 to about 24 carbon atoms, or by the formula:

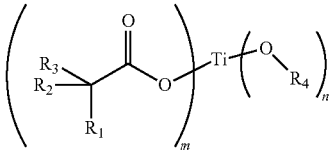

wherein m+n=4 and n ranges from 1 to 3, $R_4$ is an alkyl moiety with carbon atoms ranging from 1-8, $R_1$ is selected from a hydrocarbyl group containing from about 6 to 25 carbon atoms, and $R_2$ and $R_3$ are the same or different and are selected from a hydrocarbyl group containing from about 1 to 6 carbon atoms, or the titanium compound may be represented by the formula:

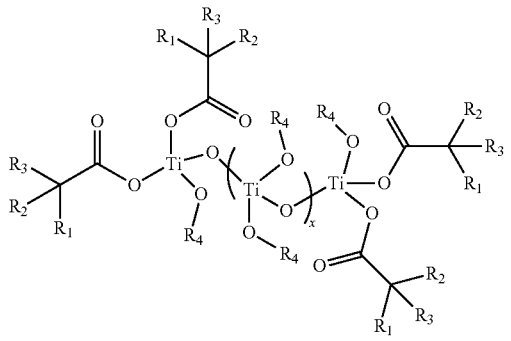

wherein x ranges from 0 to 3, $R_1$ is selected from a hydrocarbyl group containing from about 6 to 25 carbon atoms, $R_2$, and $R_3$ are the same or different and are selected from a hydrocarbyl group containing from about 1 to 6 carbon atoms, and $R_4$ is selected from a group consisting of either H, or $C_6$ to $C_{25}$ carboxylic acid moiety.

Suitable carboxylic acids may include, but are not limited to caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like.

In an embodiment the oil soluble titanium compound may be present in the lubricating oil composition in an amount to provide from 0 to 3000 ppm titanium by weight or 25 to about 1500 ppm titanium by weight or about 35 ppm to 500 ppm titanium by weight or about 50 ppm to about 300 ppm.

Viscosity Index Improvers:

The lubricating oil compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 20 wt %, about 0.1 wt % to about 15 wt %, about 0.1 wt % to about 12 wt %, or about 0.5 wt % to about 10 wt %, of the lubricating oil composition.

Other Optional Additives:

Other additives may be selected to perform one or more functions required of a lubricating fluid. Further, one or more of the mentioned additives may be multi-functional and provide functions in addition to or other than the function prescribed herein.

A lubricating oil composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include polymethylmethacrylates or mixtures thereof. Pour point depressants may be present in an amount sufficient to provide from about wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid.

The rust inhibitor, if present, can be used in an amount sufficient to provide about wt % to about 5 wt %, about 0.01 wt % to about 3 wt %, about 0.1 wt % to about 2 wt %, based upon the final weight of the lubricating oil composition.

In general terms, a suitable lubricant including the detergent metals herein may include additive components in the ranges listed in the following table.

TABLE 2

| Suitable Lubricating Compositions | | |
|---|---|---|
| Component | Wt. % (Suitable Embodiments) | Wt. % (Suitable Embodiments) |
| Detergent Systems | 0.02-5.0 | 0.2-2.0 |
| Succinimide Dispersant(s) | 0-8.0 | 1-6.0 |
| Antioxidant(s) | 0.1-5.0 | 0.01-3.0 |
| Other Detergent(s) | 0.0-15.0 | 0.2-8.0 |
| Ashless TBN booster(s) | 0.0-1.0 | 0.01-0.5 |
| Corrosion inhibitor(s) | 0.0-5.0 | 0.0-2.0 |
| Metal dihydrocarbyldithiophosphate(s) | 0.0-6.0 | 0.1-4.0 |
| Ash-free phosphorus compound(s) | 0.0-6.0 | 0.0-4.0 |
| Antifoaming agent(s) | 0.0-5.0 | 0.001-0.15 |
| Antiwear agent(s) | 0.0-1.0 | 0.0-0.8 |
| Pour point depressant(s) | 0.0-5.0 | 0.01-1.5 |
| Viscosity index improver(s) | 0.0-25.0 | 0.1-15.0 |
| Dispersant viscosity index improver(s) | 0.0-10.0 | 0.0-5.0 |
| Friction modifier(s) | 0.00-5.0 | 0.01-2.0 |
| Base oil | Balance | Balance |
| Total | 100 | 100 |

The percentages of each component above represent the weight percent of each component, based upon the weight of the final lubricating oil composition. The remainder of the lubricating oil composition consists of one or more base oils. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). Fully formulated lubricants conventionally contain an additive package, referred to herein as a dispersant/inhibitor package or DI package, that will supply the characteristics that are required in the formulation.

Definitions

For purposes of this disclosure, the chemical elements are identified in accordance with the Periodic Table of the Elements, CAS version, Handbook of Chemistry and Physics, 75th Ed. Additionally, general principles of organic chemistry are described in "Organic Chemistry", Thomas Sorrell, University Science Books, Sausolito: 1999, and "March's Advanced Organic Chemistry", 5th Ed., Ed.: Smith, M. B. and March, J., John Wiley & Sons, New York: 2001, the entire contents of which are hereby incorporated by reference.

As described herein, compounds may optionally be substituted with one or more substituents, such as are illustrated generally above, or as exemplified by particular classes, subclasses, and species of the disclosure.

Unless otherwise apparent from the context, the term "major amount" is understood to mean an amount greater than or equal to 50 weight percent, for example, from about 80 to about 98 weight percent relative to the total weight of the composition. Moreover, as used herein, the term "minor amount" is understood to mean an amount less than 50 weight percent relative to the total weight of the composition.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include: (1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical); (2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy); (3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein the term "aliphatic" encompasses the terms alkyl, alkenyl, alkynyl, each of which being optionally substituted as set forth below.

As used herein, an "alkyl" group refers to a saturated aliphatic hydrocarbon group containing 1-12 (e.g., 1-8, 1-6, or 1-4) carbon atoms. An alkyl group can be straight or branched. Examples of alkyl groups include, but are not limited to, methyl, ethyl, propyl, isopropyl, butyl, isobutyl, sec-butyl, tert-butyl, n-pentyl, n-heptyl, or 2-ethylhexyl. An alkyl group can be substituted (i.e., optionally substituted) with one or more substituents such as halo, phospho, cycloaliphatic [e.g., cycloalkyl or cycloalkenyl], heterocycloaliphatic [e.g., heterocycloalkyl or heterocycloalkenyl], aryl, heteroaryl, alkoxy, aroyl, heteroaroyl, acyl [e.g., (aliphatic) carbonyl, (cycloaliphatic)carbonyl, or (heterocycloaliphatic) carbonyl], nitro, cyano, amido [e.g., (cycloalkylalkyl)carbonylamino, arylcarbonylamino, aralkylcarbonylamino, (heterocycloalkyl) carbonylamino, (heterocycloalkylalkyl) carbonylamino, heteroarylcarbonylamino, heteroaralkyl carbonylamino alkylaminocarbonyl, cycloalkylaminocarbonyl, heterocycloalkylaminocarbonyl, arylaminocarbonyl, or heteroarylaminocarbonyl], amino [e.g., aliphaticamino, cycloaliphatic amino, or heterocycloaliphaticamino], sulfonyl [e.g., aliphatic-$SO_2$—], sulfinyl, sulfanyl, sulfoxy, urea, thiourea, sulfamoyl, sulfamide, oxo, carboxy, carbamoyl, cycloaliphaticoxy, heterocyclo aliphaticoxy, aryloxy, heteroaryloxy, aralkyloxy, heteroarylalkoxy, alkoxycarbonyl, alkyl carbonyloxy, or hydroxy. Without limitation, some examples of substituted alkyls include carboxyalkyl (such as HOOC-alkyl, alkoxycarbonylalkyl, and alkylcarbonyloxyalkyl), cyanoalkyl, hydroxyalkyl, alkoxyalkyl, acylalkyl, aralkyl, (alkoxyaryl)alkyl, (sulfonylamino) alkyl (such as (alkyl-$SO_2$-amino)alkyl), aminoalkyl, amidoalkyl, (cycloaliphatic)alkyl, or haloalkyl.

As used herein, an "alkenyl" group refers to an aliphatic carbon group that contains 2-8 (e.g., 2-12, 2-6, or 2-4) carbon atoms and at least one double bond. Like an alkyl group, an alkenyl group can be straight or branched. Examples of an alkenyl group include, but are not limited to allyl, isoprenyl, 2-butenyl, and 2-hexenyl. An alkenyl group can be optionally substituted with one or more substituents such as halo, phospho, cycloaliphatic [e.g., cycloalkyl or cycloalkenyl], heterocycloaliphatic [e.g., heterocycloalkyl or hetero cycloalkenyl], aryl, heteroaryl, alkoxy, aroyl, heteroaroyl, acyl [e.g., (aliphatic) carbonyl, (cycloaliphatic)

carbonyl, or (heterocycloaliphatic)carbonyl], nitro, cyano, amido [e.g., (cycloalkylalkyl)carbonylamino, arylcarbonylamino, aralkylcarbonylamino, (hetero cycloalkyl) carbonylamino, (heterocyclo alkylalkyl) carbonylamino, heteroarylcarbonylamino, heteroaralkylcarbonylamino alkylamino carbonyl, cycloalkylaminocarbonyl, hetero cyclo alkylaminocarbonyl, arylaminocarbonyl, or heteroarylaminocarbonyl], amino [e.g., aliphaticamino, cycloaliphaticamino, heterocyclo aliphaticamino, or aliphaticsulfonylamino], sulfonyl [e.g., alkyl-$SO_2$—, cycloaliphatic-$SO_2$—, or aryl-$SO_2$—], sulfinyl, sulfanyl, sulfoxy, urea, thiourea, sulfamoyl, sulfamide, oxo, carboxy, carbamoyl, cycloaliphaticoxy, heterocycloaliphaticoxy, aryloxy, heteroaryloxy, aralkyloxy, heteroaralkoxy, alkoxycarbonyl, alkylcarbonyloxy, or hydroxy. Without limitation, some examples of substituted alkenyls include cyanoalkenyl, alkoxyalkenyl, acylalkenyl, hydroxyl alkenyl, aralkenyl, (alkoxyaryl) alkenyl, (sulfonylamino)alkenyl (such as (alkyl-$SO_2$-amino) alkenyl), aminoalkenyl, amidoalkenyl, (cycloaliphatic)alkenyl, or haloalkenyl.

As used herein, an "alkynyl" group refers to an aliphatic carbon group that contains 2-8 (e.g., 2-12, 2-6, or 2-4) carbon atoms and has at least one triple bond. An alkynyl group can be straight or branched. Examples of an alkynyl group include, but are not limited to, propargyl and butynyl. An alkynyl group can be optionally substituted with one or more substituents such as aroyl, heteroaroyl, alkoxy, cycloalkyloxy, heterocycloalkyloxy, aryloxy, heteroaryloxy, aralkyl oxy, nitro, carboxy, cyano, halo, hydroxy, sulfo, mercapto, sulfanyl [e.g., aliphaticsulfanyl or cycloaliphaticsulfanyl], sulfinyl [e.g., aliphaticsulfinyl or cycloaliphaticsulfinyl], sulfonyl [e.g., aliphatic-$SO_2$—, aliphaticamino-$SO_2$—, or cycloaliphatic-$SO_2$—], amido [e.g., aminocarbonyl, alkylaminocarbonyl, alkylcarbonylamino, cyclo alkylaminocarbonyl, heterocycloalkylaminocarbonyl, cycloalkylcarbonylamino, arylamino carbonyl, arylcarbonylamino, aralkylcarbonylamino, (heterocycloalkyl) carbonylamino, (cycloalkylalkyl) carbonylamino, heteroaralkylcarbonylamino, heteroaryl carbonylamino or heteroaryl amino carbonyl], urea, thiourea, sulfamoyl, sulfamide, alkoxycarbonyl, alkyl carbonyloxy, cyclo aliphatic, heterocycloaliphatic, aryl, heteroaryl, acyl [e.g., (cycloaliphatic) carbonyl or (hetero cyclo aliphatic)carbonyl], amino [e.g., aliphaticamino], sulfoxy, oxo, carboxy, carbamoyl, (cycloaliphatic)oxy, (heterocyclo aliphatic) oxy, or (heteroaryl) alkoxy.

As used herein, an "amino" group refers to —$NR^XR^Y$ wherein each of $R^X$ and $R^Y$ is independently hydrogen, alkyl, cycloakyl, (cycloalkyl)alkyl, aryl, aralkyl, heterocycloalkyl, (heterocycloalkyl)alkyl, heteroaryl, carboxy, sulfanyl, sulfinyl, sulfonyl, (alkyl)carbonyl, (cycloalkyl)carbonyl, ((cycloalkyl)alkyl)carbonyl, arylcarbonyl, (aralkyl)carbonyl, (heterocyclo alkyl) carbonyl, ((heterocycloalkyl)alkyl)carbonyl, (heteroaryl)carbonyl, or (heteroaralkyl) carbonyl, each of which being defined herein and being optionally substituted. Examples of amino groups include alkylamino, dialkylamino, or arylamino. When the term "amino" is not the terminal group (e.g., alkylcarbonylamino), it is represented by —$NR^X$—. $R^X$ has the same meaning as defined above.

As used herein, a "cycloalkyl" group refers to a saturated carbocyclic mono- or bicyclic (fused or bridged) ring of 3-10 (e.g., 5-10) carbon atoms. Examples of cycloalkyl groups include cyclopropyl, cyclobutyl, cyclopentyl, cyclohexyl, cycloheptyl, adamantyl, norbornyl, cubyl, octahydroindenyl, decahydro-naphthyl, bicyclo[3.2.1]octyl, bicyclo[2.2.2]octyl, bicyclo[3.3.1]nonyl, bicyclo[3.3.2.]decyl, bicyclo[2.2.2]octyl, adamantyl, or ((aminocarbonyl)cycloalkyl)cycloalkyl.

As used herein, a "heterocycloalkyl" group refers to a 3-10 membered mono- or bicylic (fused or bridged) (e.g., 5- to 10-membered mono- or bicyclic) saturated ring structure, in which one or more of the ring atoms is a heteroatom (e.g., N, O, S, or combinations thereof). Examples of a heterocycloalkyl group include piperidyl, piperazyl, tetrahydropyranyl, tetrahydrofuryl, 1,4-dioxolanyl, 1,4-dithianyl, 1,3-dioxolanyl, oxazolidyl, isoxazolidyl, morpholinyl, thiomorpholyl, octahydrobenzofuryl, octahydrochromenyl, octahydrothio chromenyl, octahydroindolyl, octahydropyrindinyl, decahydroquinolinyl, octahydrobenzo[b]thiopheneyl, 2-oxa-bicyclo[2.2.2]octyl, 1-aza-bicyclo[2.2.2]octyl, 3-aza-bicyclo[3.2.1]octyl, and 2,6-dioxa-tricyclo[3.3.1.0]nonyl. A monocyclic heterocycloalkyl group can be fused with a phenyl moiety to form structures, such as tetrahydroisoquinoline, which would be categorized as heteroaryls.

A "heteroaryl" group, as used herein, refers to a monocyclic, bicyclic, or tricyclic ring system having 4 to 15 ring atoms wherein one or more of the ring atoms is a heteroatom (e.g., N, O, S, or combinations thereof) and in which the monocyclic ring system is aromatic or at least one of the rings in the bicyclic or tricyclic ring systems is aromatic. A heteroaryl group includes a benzofused ring system having 2 to 3 rings. For example, a benzofused group includes benzo fused with one or two 4 to 8 membered heterocycloaliphatic moieties (e.g., indolizyl, indolyl, isoindolyl, 3H-indolyl, indolinyl, benzo[b]furyl, benzo[b]thiophenyl, quinolinyl, or isoquinolinyl). Some examples of heteroaryl are pyridyl, 1H-indazolyl, furyl, pyrrolyl, thienyl, thiazolyl, oxazolyl, imidazolyl, tetrazolyl, benzofuryl, isoquinolinyl, benzthiazolyl, xanthene, thioxanthene, phenothiazine, dihydroindole, benzo[1,3]dioxole, benzo[b]furyl, benzo[b]thiophenyl, indazolyl, benzimidazolyl, benzthiazolyl, puryl, cinnolyl, quinolyl, quinazolyl, cinnolyl, phthalazyl, quinazolyl, quinoxalyl, isoquinolyl, 4H-quinolizyl, benzo-1,2,5-thiadiazolyl, or 1,8-naphthyridyl.

Without limitation, monocyclic heteroaryls include furyl, thiophenyl, 2H-pyrrolyl, pyrrolyl, oxazolyl, thazolyl, imidazolyl, pyrazolyl, isoxazolyl, isothiazolyl, 1,3,4-thiadiazolyl, 2H-pyranyl, 4-H-pranyl, pyridyl, pyridazyl, pyrimidyl, pyrazolyl, pyrazyl, or 1,3,5-triazyl. Monocyclic heteroaryls are numbered according to standard chemical nomenclature.

Without limitation, bicyclic heteroaryls include indolizyl, indolyl, isoindolyl, 3H-indolyl, indolinyl, benzo[b]furyl, benzo[b]thiophenyl, quinolinyl, isoquinolinyl, indolizinyl, isoindolyl, indolyl, benzo[b]furyl, bexo[b]thiophenyl, indazolyl, benzimidazyl, benzthiazolyl, purinyl, 4H-quinolizyl, quinolyl, isoquinolyl, cinnolyl, phthalazyl, quinazolyl, quinoxalyl, 1,8-naphthyridyl, or pteridyl. Bicyclic heteroaryls are numbered according to standard chemical nomenclature.

As used herein, the term "treat rate" refers to the weight percent of a component in the lubricating and cooling fluids.

The weight average molecular weight (Mw) and the number average molecular weight (Mn) may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5 II, and pore size ranging from 100-10000 Å) with the column temperature at about 40° C. Un-stabilized HPLC grade tetrahydrofuran (THF) may be used as solvent, at a flow rate of 1.0 mL/min. The GPC instrument may be calibrated with commercially available poly(methyl methacrylate) (PMMA) standards having a narrow molecular weight distribution ranging from 960-1,568,000 g/mol. The calibration curve can be extrapolated for samples having a mass less than 500 g/mol. Samples and PMMA standards can be in dissolved in THF and prepared at concentration of 0.1 to 0.5 wt. % and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modem Size Exclusion Liquid Chromatography", John Wiley and Sons, New York, 1979, also incorporated herein by reference.

EXAMPLES

A better understanding of the present disclosure and its many advantages may be clarified with the following examples. The following examples are illustrative and not limiting thereof in either scope or spirit. Those skilled in the art will readily understand that variations of the components, methods, steps, and devices described in these examples can be used. Unless noted otherwise or apparent from the context of discussion in the Examples below and throughout this disclosure, all percentages, ratios, and parts noted in this disclosure are by weight.

Comparative Example 1

Lubricating compositions were evaluated for Sequence IVB Engine performance pursuant to ASTM D8350. The testing generally involve about 200 hours of 24,000 thirty-second cycles with each cycle including four stages including two steady-state stages with transition ramp stages between them as set forth in the ASTM test method. Average intake lifter wear volume and end-of-test oil iron concentration was measured. Passing performance is less than 2.7 $mm^3$ of average volume loss of the intake lifters and less than 400 ppm of iron loss at the end of test.

The Comparative lubricating compositions evaluated for this Example were formulated to 0W-8 viscosity grade and included overbased calcium sulfonate and overbased magnesium sulfonate detergents and the noted amount of molybdenum from molybdenum dithiocarbamate to provide the fluid relationships of Table 3 below as well as a similar base additive package including dispersants, antiwear additives, an antioxidant, an antifoam, a friction modifier, and about 0.05 weight percent of a polymeric pour point depressant (copolymer of alkyl methacrylate and vinyl pyrrolidone) in a Group III base oil to achieve a KV100 of about 5 cSt (ASTM D445).

TABLE 3

| Fluid Relationships | | |
|---|---|---|
| Ingredient | Comparative 1 | Comparative 2 |
| Calcium, ppm | 1227 | 1238 |
| Magnesium, ppm | 392 | 392 |
| Molybdenum, ppm | 0 | 836 |
| Calcium soap, % wt | 0.260 | 0.260 |
| Magnesium soap, % wt | 0.116 | 0.116 |
| Sulphonate soap, % wt | 0.376 | 0.376 |

TABLE 3-continued

| Fluid Relationships | | |
|---|---|---|
| Ingredient | Comparative 1 | Comparative 2 |
| Detergent TBN, mg KOH/g (ASTM D4739) | 4.71 | 4.71 |
| Magnesium detergent TBN, mg KOH/g (ASTM D4739) | 1.64 | 1.64 |
| Magnesium detergent TBN/total Detergent TBN | 0.348 | 0.348 |

TABLE 4

| Sequence IVB (ASTM D8350) | | | |
|---|---|---|---|
| Lubricant | Intake Lifter Average Volume Loss, $mm^3$ | End of Test Iron, ppm | Result |
| Comparative 1 | 2.26 | 247 | PASS |
| Comparative 2 | 2.92 | 443 | FAIL |

As shown in Table 4, while Comparative lubricant 1 passed the Sequence IVB testing, it did not include any molybdenum from a molybdenum dithiocarbamate additive, and thus, is expected to fail the motor friction test of JASO M365. Comparative lubricant 2 is expected to pass the motor friction test of JASO M365 when including 820 ppm of molybdenum from a molybdenum dithiocarbomate additive, but then failed the Sequence IVB performance in view of the high levels of molybdenum.

Example 1

An Inventive lubricating composition was evaluated for Sequence IVB Engine performance pursuant to ASTM D8350 as set forth in Comparative Example 1. The Inventive lubricating composition evaluated for this Example was formulated to 0W-8 viscosity grade and included overbased calcium sulfonate and overbased magnesium sulfonate detergents and the noted amount of molybdenum from molybdenum dithiocarbamate to provide the fluid relationships of Table 5 below as well as a similar additive package as those of Comparative Example 1 including dispersants, antiwear additives, an antioxidant, an antifoam, a friction modifier, and about 0.05 weight percent of a polymeric pour point depressant (copolymer of alkyl methacrylates and vinyl pyrrolidone) in a Group III base oil to achieve a KV100 of about 5 cSt (ASTM D445).

TABLE 5

| Fluid Relationships | |
|---|---|
| Ingredient | Inventive 1 |
| Calcium, ppm | 1210 |
| Magnesium, ppm | 531 |
| Molybdenum, ppm | 842 |
| Calcium soap, % wt | 0.260 |
| Magnesium soap, % wt | 0.158 |
| Sulphonate soap, % wt | 0.418 |
| Detergent TBN, mg KOH/g (ASTM D4739) | 5.31 |
| Magnesium detergent TBN, mg KOH/g (ASTM D4739) | 2.235 |
| Magnesium detergent TBN/total Detergent TBN | 0.42 |

TABLE 6

| Sequence IVB (ASTM D8350) | | | |
|---|---|---|---|
| Lubricant | Intake Lifter Average Volume Loss, $mm^3$ | End of Test Iron, ppm | Result |
| Inventive 1 | 2.34 | 244 | PASS |

As shown in Table 6, Inventive lubricant 1 having an increased amount of detergent TBN provided by the magnesium sulfonate when combined with the high levels of molybdenum passing the motor friction test also achieved passing sequence IVB performance at the same time.

Comparative Example 2

Additional Comparative Lubricating compositions were evaluated for Sequence IVB Engine performance pursuant to ASTM D8350 as set forth in Comparative Example 1 and when including the high levels of molybdenum needed to pass the motor friction test. The Comparative lubricating compositions evaluated for this Example were also formulated to 0W-8 viscosity grade and included overbased calcium sulfonate and overbased magnesium sulfonate detergents and the noted amount of molybdenum from molybdenum dithiocarbamate to provide the fluid relationships of Table 7 below as well as a similar additive package as those of Comparative Example 1 including dispersants, antiwear additives, an antioxidant, an antifoam, a friction modifier in a Group III base oil to achieve a KV100 of about 5 cSt (ASTM D445).

Comparative Lubricants 3 and 5 also included about 0.2 weight percent of the polymeric pour point depressant (copolymer of alkyl methacrylates and vinyl pyrrolidone) and Comparative lubricant 4 included about 0.05 weight percent of the polymeric pour point depressant (copolymer of alkyl methacrylates and vinyl pyrrolidone) but then included 0.6 weight percent of a phenolic antioxidant.

TABLE 7

| Fluid Relationships | | | |
|---|---|---|---|
| Ingredient | Comparative 3 | Comparative 4 | Comparative 5 |
| Calcium, ppm | 1230 | 1225 | 1246 |
| Magnesium, ppm | 535 | 385 | 386 |
| Molybdenum, ppm | 847 | 864 | 870 |
| Calcium soap, % wt | 0.260 | 0.260 | 0.260 |
| Magnesium soap, % wt | 0.158 | 0.116 | 0.116 |
| Sulphonate soap, % wt | 0.418 | 0.376 | 0.376 |
| Detergent TBN, mg KOH/g (ASTM D4739) | 5.31 | 4.71 | 4.71 |
| Magnesium detergent TBN, mg KOH/g (ASTM D4739) | 2.235 | 1.64 | 1.64 |
| Magnesium detergent TBN/ total Detergent TBN | 0.42 | 0.348 | 0.348 |

TABLE 8

| Sequence IVB (ASTM D8350) | | | |
|---|---|---|---|
| Lubricant | Intake Lifter Average Volume Loss, $mm^3$ | End of Test Iron, ppm | Result |
| Comparative 3 | 3.4 | 290 | FAIL |
| Comparative 4 | 2.82 | 296 | FAIL |
| Comparative 5 | 3.67 | 834 | FAIL |

A shown in Table 8, even though the fluids of this Comparative example are expected to pass the motored friction test of JASO M365 due to the high content of molybdenum from the molybdenum dithiocarbamate additive, none of these comparative lubricants could achieve passing performance in the sequence IVB testing without the correct balance of magnesium detergent TBN relative to the other lubricant components.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. An engine lubricating oil composition providing improved low temperature valve train wear pursuant to the Sequence IVB engine test of ASTM D8350, the engine oil lubricating composition comprising:

one or more base oils of lubricating viscosity;

about 300 to about 1000 ppm molybdenum from an oil-soluble molybdenum compound;

one or more metal-containing detergents providing greater than about 5 TBN to the lubricating oil composition, wherein the TBN is measured using ASTM D4739;

wherein at least one of the one or more metal-containing detergents comprises an overbased magnesium detergent providing greater than about 2 TBN to the lubricating oil composition, wherein the TBN is measured using ASTM D4739;

less than about 0.2 weight percent of a polymeric pour point depressant;

wherein the engine oil composition has a viscosity grade according to SAE J 300 of 0W-8, 0W-12, 0W-16, or 0W-20; and wherein a weight ratio of magnesium-to-molybdenum is about 0.8:1 or less.

2. The engine lubricating oil composition of claim 1, wherein the one or more overbased magnesium-containing detergent includes a magnesium sulfonate.

3. The engine lubricating oil composition of claim 1, wherein the lubricating oil composition further includes a calcium-containing detergent.

4. The engine lubricating oil composition of claim 1, wherein the one or more overbased magnesium-containing detergent has a total base number (TBN) of at least about 250 mg KOH/g.

5. The engine lubricating oil composition of claim 1, wherein the polymeric pour point depressant is a poly(meth) acrylate-based pour point depressant.

6. The engine lubricating oil composition of claim 5, wherein the polymeric pour point depressant is a poly(meth) acrylate copolymer having monomer units including (i) one or more monomer units selected from C1 to C16 (meth) acrylates and (2) vinyl pyrrolidone monomer units.

7. The engine lubricating oil composition of claim 5, wherein the engine lubricating oil composition is substantially free of poly(meth)acrylate-based dispersant pour point depressants.

8. The engine lubricating oil composition of claim 1, wherein the lubricating oil composition lubricates a hybrid gasoline-electric engine.

9. The engine lubricating oil composition of claim 8, wherein the hybrid gasoline electric engine includes a 2.0 liter or smaller gasoline engine.

10. The engine lubricating oil composition of claim 1, wherein the lubricating oil composition exhibits an average intake lifter volume loss of 2.7 $mm^3$ or less and a maximum end-of-test iron content of 400 ppm or less when measured pursuant to the sequence IVB engine test of ASTM D8350.

11. A method of lubricating a hybrid gasoline-electric engine to achieve improved low temperature valve train wear pursuant to the Sequence IVB engine test of ASTM D8350, the method comprising:

lubricating a hybrid electric-gasoline engine with a lubricating oil composition having a viscosity grade according to SAE J 300 of 0W-8, 0W-12, 0W-16, or 0W-20; and the lubricating oil composition including one or more base oils of lubricating viscosity; about 300 to about 1000 ppm molybdenum from an oil-soluble molybdenum compound; one or more metal-containing detergent providing greater than about 5 TBN to the lubricating oil composition, wherein TBN is measured using ASTM D4739; wherein the at least one of the one or more metal-containing detergent comprises an overbased magnesium detergent providing greater than about 2 TBN to the lubricating oil composition, wherein the TBN is measured using ASTM D4739; and less than about 0.2 weight percent of a polymeric pour point depressant and wherein a weight ratio of magnesium-to-molybdenum in the lubricating oil composition is about 0.8:1 or less.

12. The method of claim 11, wherein the one or more overbased magnesium-containing detergents includes a magnesium sulfonate.

13. The method of claim 11, wherein the lubricating oil composition further includes a calcium-containing detergent.

14. The method of claim 11, wherein the one or more overbased magnesium-containing detergents has a total base number (TBN) of at least about 250 mg KOH/g.

15. The method of claim 11, wherein the polymeric pour point depressant is a poly(meth)acrylate-based pour point depressant.

16. The method of claim 15, wherein the polymeric pour point depressant is a poly(meth)acrylate copolymer having monomer units including (i) one or more monomer units selected from C1 to C16 (meth)acrylates and (ii) vinyl pyrrolidone monomer units.

17. The method of claim 15, wherein the lubricating oil composition is substantially free of the poly(meth)acrylate-based pour point depressants.

18. The method of claim 11, wherein the hybrid gasoline-electric engine includes a 2.0 liter or smaller gasoline engine.

19. The method of claim 11, wherein the lubricating oil composition exhibits an average intake lifter volume loss of 2.7 $mm^3$ or less and a maximum end-of-test iron content of 400 ppm or less when measured pursuant to the sequence IVB engine test of ASTM D8350.

20. The method of claim 11, wherein about 40 percent to about 100 percent of the detergent TBN is provided by an overbased magnesium sulfonate.

* * * * *